US007277076B2

(12) United States Patent
Shiomi et al.

(10) Patent No.: US 7,277,076 B2
(45) Date of Patent: Oct. 2, 2007

(54) METHOD OF DRIVING A DISPLAY, DISPLAY, AND COMPUTER PROGRAM THEREFOR

(75) Inventors: Makoto Shiomi, Tenri (JP); Kazunari Tomizawa, Kyoto (JP); Koichi Miyachi, Kyoto (JP); Mitsuhiro Shigeta, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 614 days.

(21) Appl. No.: 10/743,767

(22) Filed: Dec. 24, 2003

(65) Prior Publication Data

US 2004/0135800 A1 Jul. 15, 2004

(30) Foreign Application Priority Data

Dec. 27, 2002 (JP) ..... 2002-381550

(51) Int. Cl.
*G09G 3/36* (2006.01)

(52) U.S. Cl. ..... 345/89; 345/101; 345/600; 345/690

(58) Field of Classification Search ..... 345/87, 345/89, 94, 95, 101, 600–602, 690, 691
See application file for complete search history.

(56) References Cited

U.S. PATENT DOCUMENTS 5,347,294 A * 9/1994 Usui et al. ..... 345/89
5,514,865 A * 5/1996 O'Neil ..... 250/208.1
6,501,451 B1 * 12/2002 Sakashita ..... 345/87
7,068,320 B2 * 6/2006 Tomizawa et al. ..... 348/448
2002/0004415 A1 1/2002 Ito et al.
2002/0140652 A1 * 10/2002 Suzuki et al. ..... 345/87
2002/0180883 A1 * 12/2002 Tomizawa et al. ..... 348/448

FOREIGN PATENT DOCUMENTS

| | | |
|---|---|---|
| JP | 1010299 | 1/1989 |
| JP | 2650479 | 9/1990 |
| JP | 2650479 B2 | 5/1997 |
| JP | 2708746 B2 | 10/1997 |
| JP | 2002116743 | 4/2002 |

* cited by examiner

*Primary Examiner*—Amr A. Awad
*Assistant Examiner*—Tom V Sheng
(74) *Attorney, Agent, or Firm*—Harness, Dickey & Pierce

(57) ABSTRACT

In a method for driving a display, a display, and a program therefor, a memory stores uncorrected video data for a desired frame and for a current frame until a next frame. Meanwhile, a correction section reads uncorrected video data for the previous frame and the current frame from the memory and corrects the video data for the current frame. Further, a processing section corrects video data for the next frame based on the corrected video data for current frame so as to facilitate a grayscale level transition from the current frame to the next frame.

34 Claims, 9 Drawing Sheets

FIG. 7

| S \ E | 0 | 32 | 64 | 96 | 128 | 160 | 192 | 224 | 255 |
|---|---|---|---|---|---|---|---|---|---|
| 0 | 0 | 35 | 63 | 93 | 123 | 155 | 176 | 192 | 194 |
| 32 | 26 | 32 | 63 | 94 | 125 | 157 | 189 | 223 | 239 |
| 64 | 42 | 42 | 64 | 95 | 126 | 157 | 188 | 224 | 246 |
| 96 | 56 | 56 | 65 | 96 | 127 | 159 | 190 | 224 | 249 |
| 128 | 64 | 64 | 64 | 96 | 128 | 158 | 190 | 223 | 251 |
| 160 | 76 | 76 | 76 | 97 | 128 | 160 | 191 | 225 | 253 |
| 192 | 90 | 90 | 90 | 99 | 128 | 160 | 192 | 224 | 254 |
| 224 | 112 | 112 | 112 | 112 | 129 | 160 | 191 | 224 | 254 |
| 255 | 134 | 134 | 134 | 134 | 134 | 159 | 192 | 223 | 255 |

α2

α1

FIG. 8

| S \ E | 0 | 32 | 64 | 96 | 128 | 160 | 192 | 224 | 255 |
|---|---|---|---|---|---|---|---|---|---|
| 0 | 0 | 32 | 64 | 96 | 128 | 160 | 176 | 192 | 194 |
| 32 | 26 | 32 | 64 | 96 | 128 | 160 | 192 | 224 | 239 |
| 64 | 42 | 42 | 64 | 96 | 128 | 160 | 192 | 224 | 255 |
| 96 | 56 | 56 | 64 | 96 | 128 | 160 | 192 | 224 | 255 |
| 128 | 64 | 64 | 64 | 96 | 128 | 160 | 192 | 224 | 255 |
| 160 | 76 | 76 | 76 | 96 | 128 | 160 | 192 | 224 | 255 |
| 192 | 90 | 90 | 90 | 96 | 128 | 160 | 192 | 224 | 255 |
| 224 | 112 | 112 | 112 | 112 | 128 | 160 | 192 | 224 | 255 |
| 255 | 134 | 134 | 134 | 134 | 134 | 160 | 192 | 224 | 255 |

α2

α1

α3

METHOD OF DRIVING A DISPLAY, DISPLAY, AND COMPUTER PROGRAM THEREFOR

CROSS-REFERENCE TO RELATED CASES

This Nonprovisional application hereby claims priority under 35 U.S.C. § 119(a) to Japanese Patent Application No. 2002-381550 filed in Japan on Dec. 27, 2002, the entire contents of which are hereby incorporated by reference. This application also is related to co-pending and commonly assigned U.S. patent application Ser. No. 10/679,477 by Shiomi et al., filed Oct. 7, 2003 and entitled "METHOD OF DRIVING A DISPLAY, DISPLAY, AND COMPUTER PROGRAM FOR THE SAME, the entire contents of which is incorporated by reference herein.

BACKGROUND OF THE INVENTION

1. Field of the Invention

The present invention generally relates to a method of driving a display, a display, a drive signal processor, a computer program for the same, and a computer-readable storage medium with the program recorded thereon.

2. Description of Related Art

Liquid crystal displays with low operating power are in widespread use not only in mobile devices but also in stationary types. In comparison to the CRT (Cathode-Ray Tube) and the like, the liquid crystal display is slow to respond and may fail to completely respond within a rewrite time (16.7 msec) which corresponds to a typical frame frequency (60 Hz) depending on grayscale level. This issue is addressed in, for example, Japanese published unexamined patent application 2002-116743 (Tokukai 2002-116743; published Apr. 19, 2002) by driving the LCD (liquid crystal display) with a drive signal that is modulated for a quick transition from a current to a desired grayscale level.

For example, supposing that a grayscale level transition from a current frame FR(k−1) to a next frame FR(k) requires a "rise" drive. If so, a voltage is applied to a pixel so as to facilitate a transition from the current grayscale level to a desired grayscale level. Specifically, a voltage applied to the pixel is higher than that represented by video data D(i,j,k) for the next frame FR(k).

In grayscale level transition, the application of the voltage increases the brightness level of the pixel more quickly and takes less time to raise it to a proximity of the brightness level indicated in the video data D(i,j,k) for the next frame FR(k) than the faithful application of an exact voltage represented by the video data D(i,j,k) for the next frame FR(k).

However, the liquid crystal response speed may be grossly insufficient, and a suitable transition from the current to a desired grayscale level could become impossible even with a facilitation. An insufficient response may occur if the processing circuitry which determines and executes the facilitation assumes that the transition was sufficiently performed from the previous grayscale level to the current grayscale level, despite a fact that a targeted brightness level was not actually reached in the transition from the previous grayscale level to the current grayscale level.

Meanwhile, Japanese patent 2650479 (issued Sep. 3, 1997) describes a display which predicts a transmittance curve from a pixel's signal data for at least three successive fields. If the predicted transmittance curve is off a desired transmittance curve by a predetermined value or more, the display corrects the signal data for the successive fields.

FIG. 11 is a block diagram of part of a prior art display. Referring to FIG. 11, in a display 101, video data from a data input means 111 is stored by a field memory 112 before the video data is transferred to a pixel. A data correcting means 113 refers to the field memory 112 and, if a predetermined threshold value is exceeded by a difference between the predicted transmittance and an ideal transmittance, the data correcting means 113 corrects the video data in the field memory 112. A data output means 114 then sequentially reads out the corrected video data in the field memory 112 to drive the pixel (not shown in the figure).

The prior art structure of FIG. 11 thus stores corrected video data in the field memory 112. Reference is then made to the video data when the pixel is driven in the next field, to determine the need for a correction and to perform the correction. Any deviations of a predicted transmittance from an actual transmittance would be cause for an accumulative correction error. To avoid such correction errors, the prediction should be sufficiently accurate. However, enabling sufficiently accurate prediction may be difficult to accomplish absent complex, relatively large and hence costly circuitry.

SUMMARY OF THE INVENTION

An exemplary embodiment of the present invention is directed to a method of driving a display. In the method, a resultant value may be determined. The resultant value may be based on a first drive signal input at a first time and a previous drive signal input at a time previous to the first time. A second drive signal, input at a second time that is subsequent to the first time, may be modulated based on the resultant value to produce a corrected second drive signal for a pixel, so as to facilitate a tone transition from the first time to the second time.

Another exemplary embodiment of the present invention is directed to a display. The display may include a correction section and a processing section. The correction section may determine a resultant value based on a first drive signal input at a first time and a previous drive signal input at a time previous to the first time. The processing section may modulate a second drive signal, input at a second time that is subsequent to the first time, based on the resultant value received from the correction section to produce a corrected second drive signal for a pixel, so as to facilitate a tone transition from the first time to the second time.

Further exemplary embodiment is directed to a computer program causing a computer to execute the steps outlined in the exemplary method, so that execution of the program may drive a display. The program may be stored in a computer-readable storage medium for ease in storage and distribution of the program. The storage medium may be read by a computer which drives a display based on execution of the program.

BRIEF DESCRIPTION OF THE DRAWINGS

Exemplary embodiments of the present invention will become more fully understood from the detailed description herein below and the accompanying drawings, wherein like elements are represented by like reference numerals, which are by way of illustration only and thus do not limit the exemplary embodiments of the present invention and wherein:

FIG. 7 illustrates content of an exemplary lookup table provided to the modulated-drive processing section, in accordance with an exemplary embodiment of the present invention.

FIG. 8 illustrates content of another exemplary lookup table provided to the modulated-drive processing section, in accordance with an exemplary embodiment of the present invention.

DETAILED DESCRIPTION OF THE EXEMPLARY EMBODIMENTS

Embodiment 1

Figure 1:
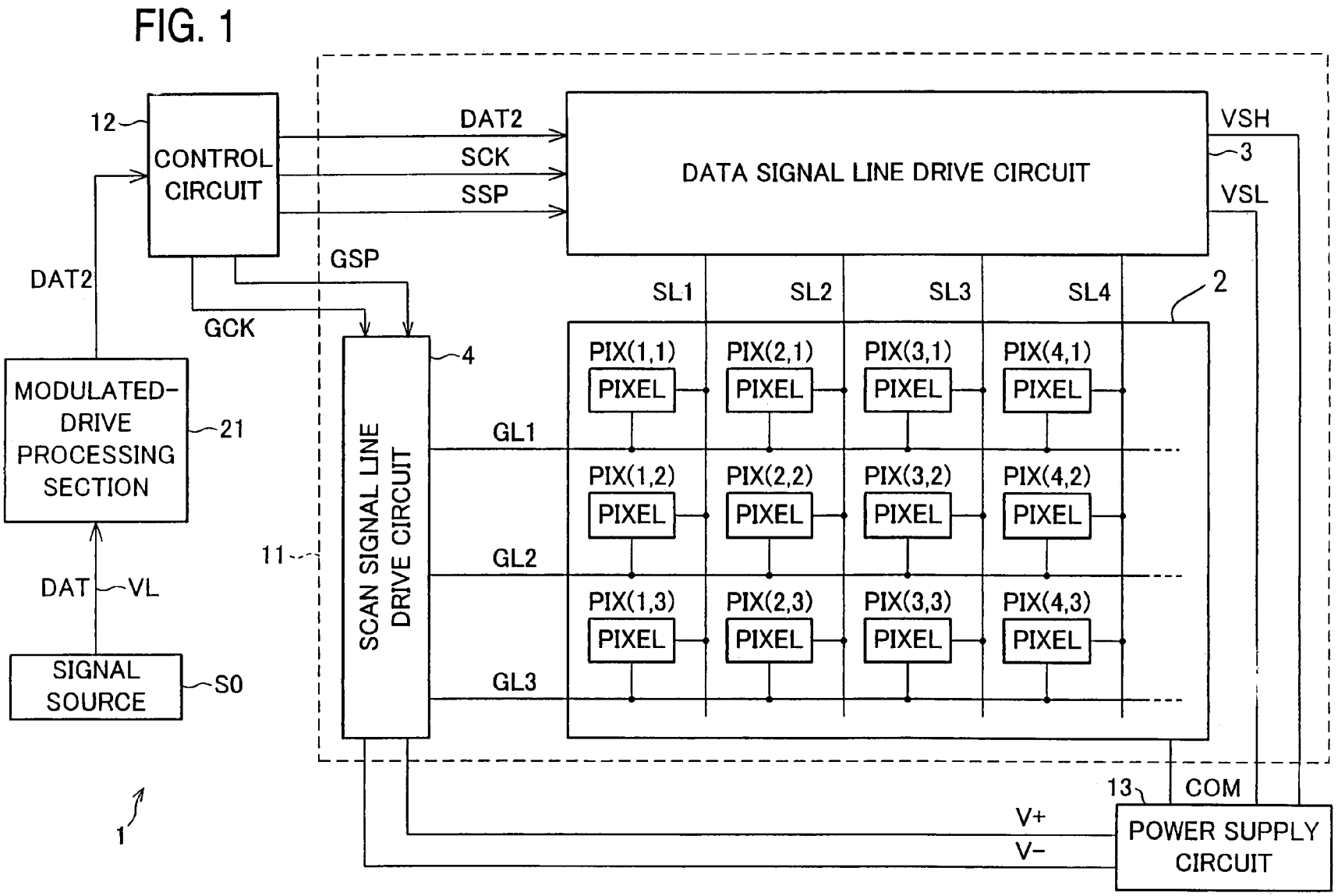
FIG. 1 is a block diagram of part of an image display, in accordance with an exemplary embodiment of the present invention.

FIG. 1 is a block diagram of part of an image display, in accordance with an exemplary embodiment of the present invention. Referring now to FIG. 1, a panel 11 of an image display 1 may include an array 2 of pixels PIX(1,1) to PIX(n,m); a data signal line drive circuit 3 driving data signal lines SL1-SLn for the pixel array 2; and a scan signal line drive circuit 4 driving scan signal lines GL1-GLm for the pixel array 2. The image display 1 may further include a control circuit 12 supplying a control signals to the drive circuits 3, 4, and a modulated-drive processing section 21 for modulating an input video signal input to output t a modulated video signal to the control circuit 12 so as to facilitate grayscale level transitions, for example. The circuitry may be powered by a power supply circuit 13.

Before describing the construction of the modulated-drive processing section 21 in detail, the construction and operation of the image display 1 as a whole will be described briefly. For convenience, reference numerals have an alphanumeric suffix identifying the individual member's position, as in "SLi" referring to the i-th data signal line, only when necessary; the suffixes are omitted when not necessary or when the numerals refer collectively to a group of identical members.

The pixel array 2 may be partly made up of multiple (n in this example) data signal lines SL1-SLn and the multiple (m in this example) scan signal lines GL1-GLm provided to cross the data signal lines SL1-SLn. A pixel PIX(i,j) is provided for each combination of a data signal line SLi and a scan signal line GLj, where i is an integer from 1 to n and j is an integer from 1 to m. In the present exemplary embodiment, each pixel PIX(i,j) is surrounded by two adjacent data signal lines SL(i−1), SLi and two adjacent scan signal lines GL(j−1), GLj.

Figure 2:
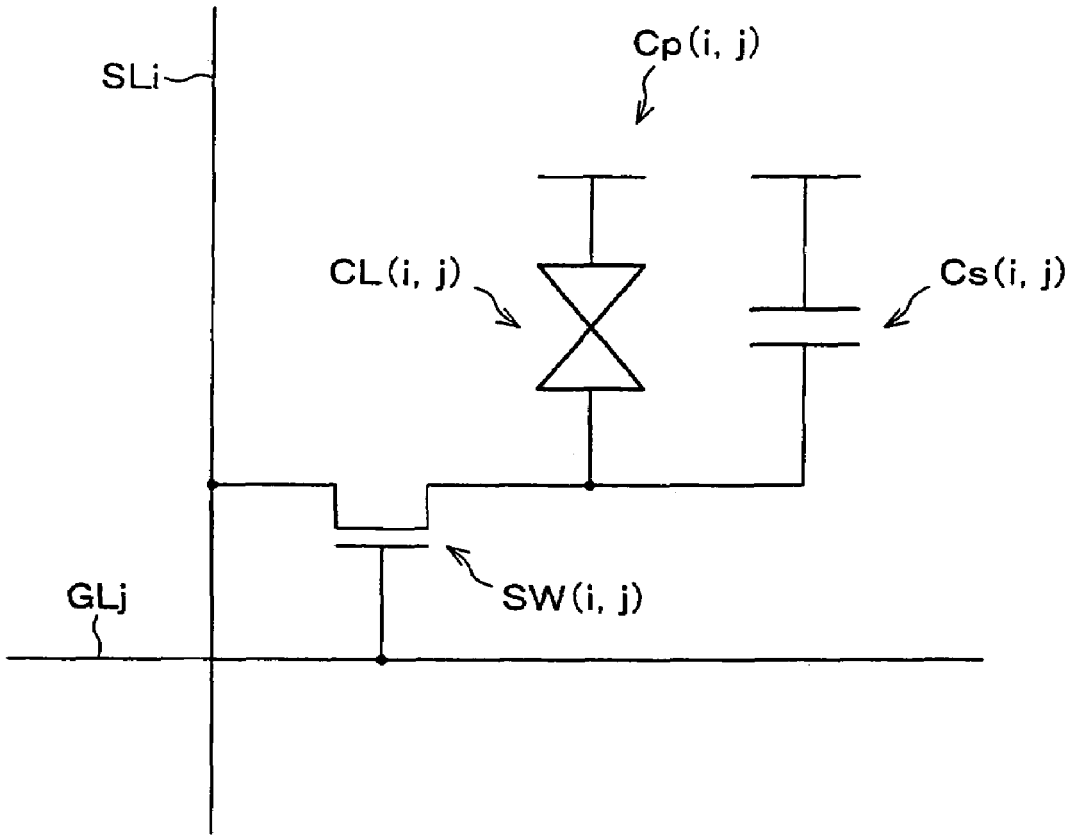
FIG. 2 is a circuit diagram of an exemplary arrangement of a pixel of the image display.

FIG. 2 is a circuit diagram of an exemplary arrangement of a pixel of the image display. An example of the pixel PIX(i,j) may be shown in FIG. 2 where the image display 1 is a liquid crystal display. In FIG. 2, the pixel PIX(i,j) may be embodied to include a field effect transistor (FET) SW(i,j) acting as a switching device, with the gate and drain connected respectively to the scan signal line GLj and data signal line SLi. The pixel PIX(i,j) may further be embodied to include a pixel capacitor Cp(i,j), an electrode of which is connected to the source of the FET SW(i,j); the other electrode connected to a common electrode line shared by all the pixels PIX. The pixel capacitor Cp(i,j) may be constructed from a liquid crystal capacitance CL(i,j), and an auxiliary capacitance Cs(i,j) may be added where necessary, for example.

The pixel PIX(i,j) may operate as follows: Selecting the scan signal line GLj turns on the FET SW(i,j), causing the voltage on the data signal line SLi to appear across the pixel capacitor Cp(i,j). Then, the scan signal line GLj is deselected to turn off the FET SW(i,j), causing the pixel capacitor Cp(i,j) to retain the voltage at the turn off. Since liquid crystal transmittance and reflectance vary depending on the voltage across the liquid crystal capacitance CL(i,j), the display state of the pixel PIX(i,j) changes according to video data D if a voltage is applied to the data signal line SLi in accordance with the video data D while the scan signal line GLj is being selected.

The liquid crystal display in accordance with the present exemplary embodiment may use liquid crystal cells of vertical align mode, it being understood that this is only one exemplary configuration for the liquid crystal display, other configurations are possible an evident to those skilled in the art. With no voltage applied, liquid crystal molecules are aligned substantially vertical to the substrate. The molecules incline off the vertical align state in accordance with the voltage across the liquid crystal capacitance CL(i,j) of the pixel PIX(i,j). In the liquid crystal display in accordance with the present exemplary embodiment, the liquid crystal cells of vertical align mode may be used in 'normally black mode' (the display appears dark under no voltage application).

Referring now to FIG. 1, the scan signal, line drive circuit 4 feeds the scan signal lines GL1-GLm with a signal indicative of a select period, such as a voltage signal. The scan signal line drive circuit 4 selects the scan signal line GLj to which to supply the select period signal, according to a clock signal GCK, a start pulse signal GSP, and other timing signals from the control circuit 12. The scan signal lines GL1-GLm are hence sequentially selected at predetermined timings.

The data signal line drive circuit 3 samples a time division video signal DAT at predetermined timings for video data D for the pixels PIX. The data signal line drive circuit 3 outputs signals to the data signal lines SL1-SLn in accordance with the respective video data D. The lines SL1-SLn then pass on the signals to the pixels PIX(1,j) to PIX(n,j) which are being selected through the scan signal line GLj by the scan signal line drive circuit 4.

The data signal line drive circuit 3 determines output timings for the samplings and signal outputs according to a clock signal SCK, a start pulse signal SSP, and other timing signals fed from the control circuit 12.

The brightness of the pixels PIX(1,j) to PIX(n,j) may be changed through the respective signals fed to the data signal lines SL1-SLn by adjusting projected light quantity, transmittance, etc., while the corresponding scan signal line GLj is being selected.

With the scan signal lines GL1-GLm sequentially selected by the scan signal line drive circuit 4, the pixels PIX(1,1) to PIX(n,m) of the pixel array 2 may be set to the brightness (grayscale level) indicated by the respective video data D, allowing for an update of the image displayed by the pixel array 2.

The video data D may be grayscale levels per se, or may be parameters from which the grayscale levels are calculated, provided that such data D specifically indicates grayscale levels for the pixels PIX(i,j). The following description is explained where the video data represent grayscale levels for the pixels PIX(i,j), as an example.

With the image display 1, the video signal DAT may be transferred frame by frame from a video signal source S0 to the modulated-drive processing section 21. A "frame" here may refer to a sufficient amount of data for the production of a display across the screen. Alternatively, each frame may be divided up into fields, and the video signal DAT may be transferred a field at a time. The following description is explained where the transfer takes place field by field, as an example.

In the present exemplary embodiment, the frames of the video signal DAT are each divided into multiple (e.g. two) fields and transferred field by field from the video signal source S0 to the modulated-drive processing section 21. To transfer the video signal DAT through the video signal line VL to the modulated-drive processing section 21 in the image display 1, the video signal source S0 may transfer video data for a complete field, before transferring video data for a next field. Video data may thus transferred by time division for each field. A field is made up of horizontal lines. Each field is transferred via the video signal line VL by transferring video data for a complete line before transferring video data for a next line. Video data may thus transferred by time division for each line.

In the present exemplary embodiment, each field may further be embodied as a pair of fields, an even field and an odd field. In an even numbered field, video data is transferred for even numbered ones of the horizontal lines forming the frame. In an odd numbered field, video data is transferred for odd numbered ones. The video signal source S0 further time divides video data for each horizontal line and may sequentially send the video data down the video signal line VL in a given sequence.

Figure 3:
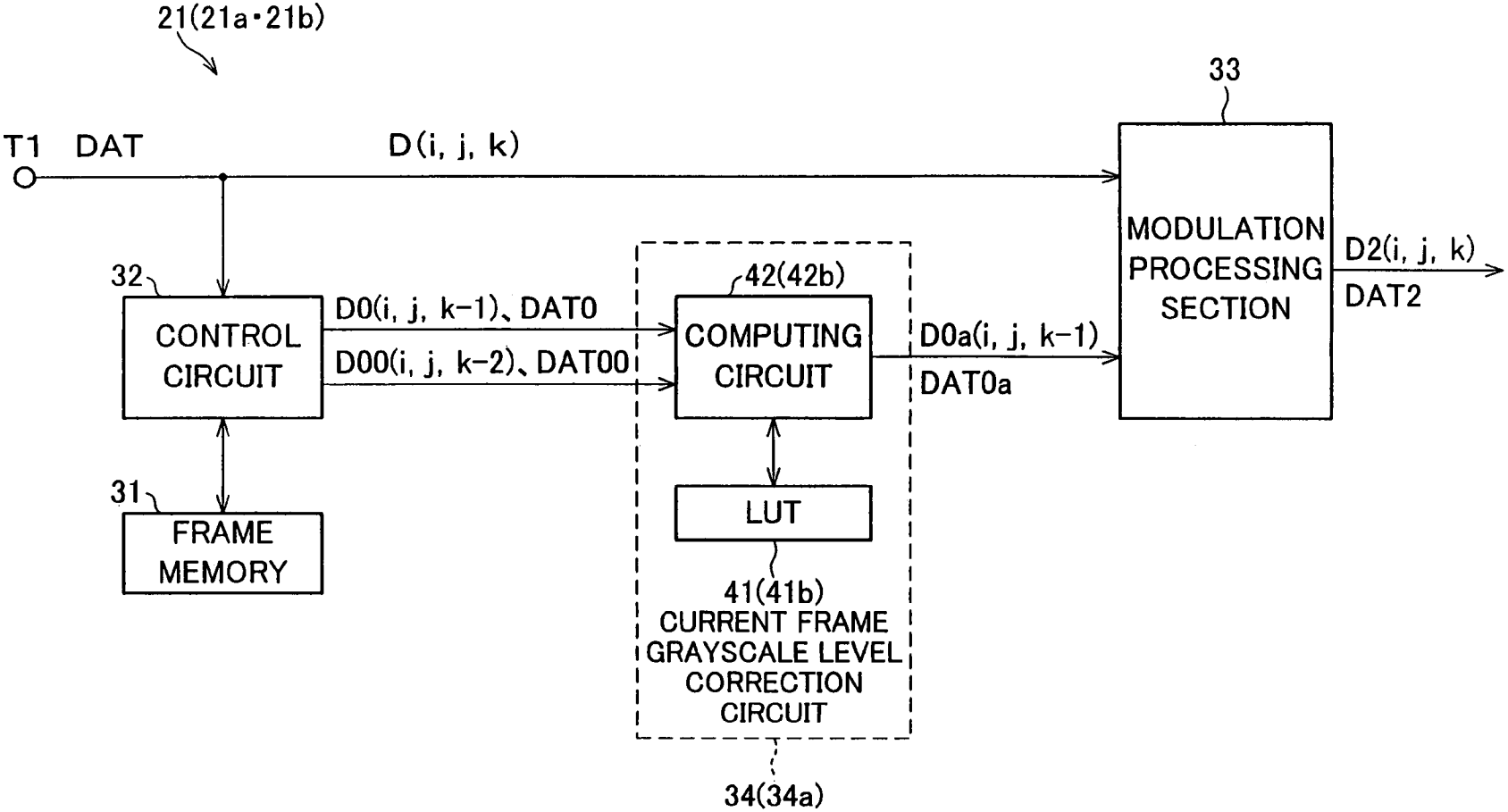
FIG. 3 is a block diagram of part of a modulated-drive processing section in accordance with an exemplary embodiment of the present invention.

FIG. 3 is a block diagram of part of a modulated-drive processing section in accordance with an exemplary embodiment of the present invention. A modulated-drive processing section 21 in accordance with the present exemplary embodiment may include a frame memory 31. The frame memory 31 may store video data for one frame until a next frame. For convenience in description, the present exemplary embodiment refers to video data output from the frame memory 31 for a current frame FR(k−1) input at a current time as D0(i,j,k−1); and that for the previous frame FR(k−2) input at a time previous to the current time as D00(i,j,k−2). The video data signal DAT0*a* produced by a current frame grayscale level correction circuit 34 (to be described in further detail below) is based on the previous video data D00(i,j,k−2) and the current video data D0(i,j,k−1), and will be referred to as D0*a*(i,j,k−1) (corrected current video data). The frame memory 31 is thus configured to store previous video data D00(i,j,k−2) of a previous frame FR(k−2) and current video data D0(i,j,k−1) of a current frame FR(k−1).

Referring to FIG. 3, the modulated-drive processing section 21 may also include a memory control circuit 32 for writing to the frame memory 31 video data D(i,j,k) for a next (second) desired frame FR(k) at a time subsequent to the current time as fed from an input terminal T1 and reading video data D0(i,j,k−1) for the current frame FR(k−1) from the frame memory 31 for output as a current (first) frame video signal DAT0. Video signal DAT0 may also be referred to as a first drive signal. Video data D(i,j,k) for the next desired frame FR(k) may be represented by frame video signal DAT (second drive signal)

The modulated-drive processing section 21 may also include a modulation processing section 33 for correcting the video data D(i,j,k) for the next desired frame FR(k) so that the grayscale level transition is facilitated from the current frame to the next desired frame, for output of corrected video data D2(i,j,k) as a (second) video signal DAT2. Video signal DAT2 may also be referred to as a corrected second drive signal.

In the present exemplary embodiment, the frame memory 31 stores video data for the current frame until a next frame, and the control circuit 32 reads video data D00(i,j,k−2) for the previous frame FR(k−2) from the memory 31 and feeds a previous frame video signal DAT00 (drive signal previous to first drive signal) to a current frame grayscale level correction circuit 34.

The modulated-drive processing section 21 of FIG. 3 may further include a current frame grayscale level correction circuit 34. The current frame grayscale level correction circuit 34 may be adapted for predicting a grayscale level reached by the pixel PIX(i,j) as a result of a grayscale level transition from the previous video data D00(i,j,k−2) to the current video data D0(i,j,k−1) in order to correct the video data D0(i,j,k−1) for the current frame FR(k−1) to a predicted video data value D0*a*(i,j,k−1) for output. The modulation processing section 33 corrects the video data D(i,j,k) for the next desired frame FR(k) based on the corrected current frame video signal DAT0*a* and the next desired frame video signal DAT, so as to facilitate the grayscale level transition of the pixel PIX(i,j) from the current frame to the next desired frame.

Under these circumstances, if the pixel PIX(i,j) is very slow to respond, the pixel PIX(i,j) may not reach the grayscale level indicated by the video data D(i,j,k−1) for the current frame FR(k−1) despite the fact that the grayscale level transition from the previous frame FR(k−2) to the current frame FR(k−1) is facilitated. When such an event occurs, the grayscale level transition for the next desired frame FR(k) may not be suitably facilitated and possibly entail excess or poor brightness if the transition is implemented assuming a grayscale level transition from the previous to the current frame was sufficiently facilitated.

Figure 4:
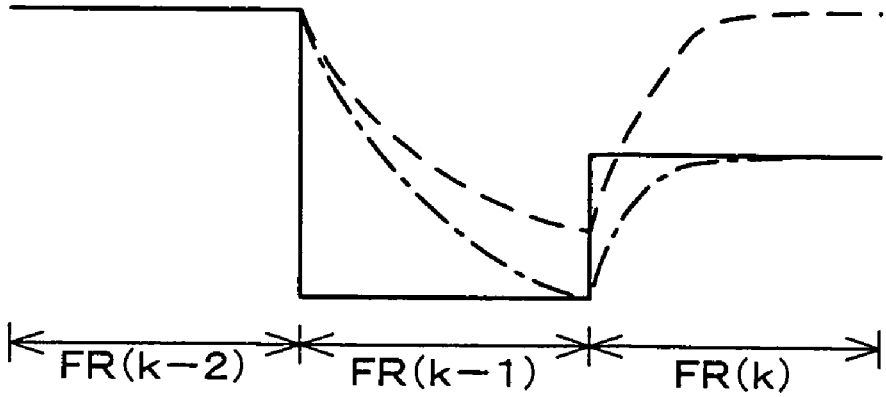
FIG. 4 is a timing chart showing actual brightness levels when the transition from a previous grayscale level to a desired grayscale level is a "fall" followed by a "rise", for illustrating operation of the modulated-drive processing section in accordance with an exemplary embodiment of the present invention.

FIG. 4 is a timing chart showing actual brightness levels when the transition from a previous grayscale level to a desired grayscale level is a "fall" followed by a "rise", for illustrating operation of the modulated-drive processing section in accordance with an exemplary embodiment of the present invention. Consider, for example, an ideal transition indicated by a solid line in FIG. 4, where the grayscale level falls and then rises in transitions from the previous frame to the next frame. A possibility is shown by a broken line in FIG. 4, where the grayscale level does not fall sufficiently in the previous-to-current transition, resulting in an insufficient decrease in brightness level at the start of the current frame FR(k−1). When (or if) this actually happens, driving the pixels for the next desired frame FR(k) in the same manner as for a sufficient grayscale level transition (indicated by a dash-dot line in FIG. 4) would facilitate the grayscale level transition at too much of a degree and cause excess brightness for that pixel on the display 1.

Figure 5:
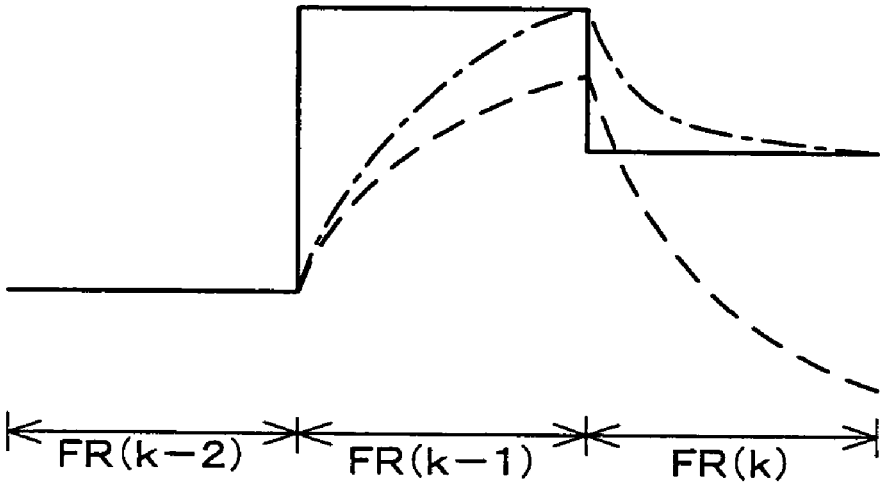
FIG. 5 is a timing chart showing actual brightness levels when the transition from the previous grayscale level to desired grayscale level is a "rise" followed by a "fall", for illustrating operation of the modulated-drive processing section in accordance with an exemplary embodiment of the present invention.

FIG. 5 is a timing chart showing actual brightness levels when the transition from the previous grayscale level to desired grayscale level is a "rise" followed by a "fall", for illustrating operation of the modulated-drive processing section in accordance with an exemplary embodiment of the present invention. Consider another ideal transition indicated by a solid line in FIG. 5, where the grayscale level rises and then falls in transitions from the previous frame to the next frame. A possibility is shown by a broken line in FIG. 5 illustrating where the grayscale level dose not rise sufficiently in the previous-to-current transition, resulting in an insufficient rise in brightness level at the start of the current frame FR(k−1). When this actually happens, driving the pixels for the next frame FR(k) in the same manner as for a sufficient grayscale level transition (indicated by a dash-dot line in FIG. 5) would facilitate the grayscale level transition at too great a degree and cause poor brightness for that pixel on display 1.

An occurrence of excess or poor brightness would be highly visible to the user, and greatly degrades the image display quality of a display, as those grayscale levels do not fall in the range between the current and the next desired grayscale levels. Particularly, excess brightness can be spotted easily by the user, and degrades display quality even if it lasts for a very limited duration.

To address the two scenarios described in FIGS. 4 and 5, the current frame grayscale level correction circuit 34 shown in FIG. 3 may be configured so as to predict a grayscale level reached by the pixel PIX(i,j) in a grayscale level transition from the previous frame to the current frame, based on the uncorrected video data D00(i,j,k−2) and D0(i,j,k−1), and may modify or adjust the video data D0(i,j,k−1) for the current frame FR(k−1) to a predicted video data value D0*a*(i,j,k−1), i.e., the corrected current video data. This may prevent the occurrence of excess or poor brightness, potentially improving display quality of the image display 1.

Figure 11:
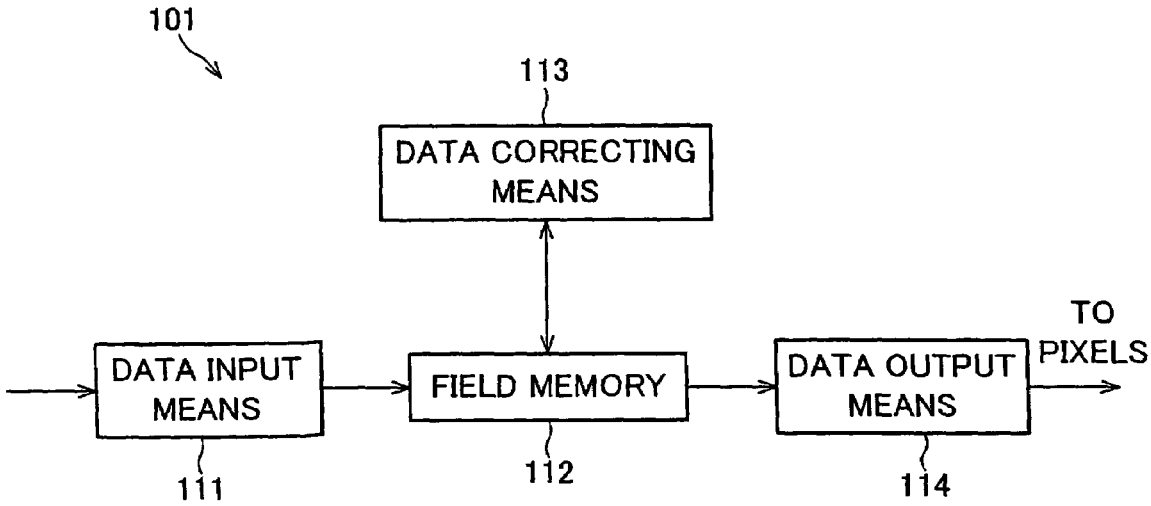
FIG. 11 is a block diagram of part of a prior art display.

Moreover, and unlike the display 101 of FIG. 11, the frame memory 31 accumulates few, if any, errors in correction over time. This is because the frame memory 31 stores the uncorrected video data for the previous and current frames (D00(i,j,k−2) and D0(i,j,k−1). Accordingly, any reduction in predictive computing accuracy does not cause divergent or oscillating pixel grayscale level control (as in the image display 101) provided that the reductions are within given bounds where excess or poor brightness does not occur. Thus, an image display 1 may be provided that is capable of substantially reducing and/or possibly preventing the occurrence of excess or poor brightness with greater accuracy, and smaller circuitry, that a conventional image display 101.

Referring again to FIG. 3, the current frame grayscale level correction circuit 34 may include a lookup table (LUT) 41. The LUT 41 contains grayscale levels actually reached by the pixel PIX(i,j) when the pixel is about to be driven in accordance with the next video data, for all combinations of a previous grayscale level and a current grayscale level. In the present embodiment, however, to reduce the size of the LUT 41, it does not contain the actual grayscale level for every possible combination of a previous grayscale level and a current grayscale level. The missing grayscale levels are instead generated by a computing circuit 42 provided in the current frame grayscale level correction circuit 34. The computing circuit 42 generates the missing grayscale levels by interpolating between the existing grayscale levels in the LUT 41, so that the LUT 41 can provide, as a predicted value D0*a*(i,j,k−1)), an actual grayscale level corresponding to every possible combination of the previous video data D00(i,j,k−2) and current video data D0(i,j,k−1).

In the present exemplary embodiment, the control circuit 32 reduces the bit depth of the video data D(i,j,k) for the next desired frame FR(k) before the frame memory 31 stores the data, in order to reduce the required capacity of the frame memory 31. In the next desired frame FR(k), the control circuit 32 further reduces the bit depth of the video data D0(i,j,k−1) for the current frame FR(k−1) before the frame memory 31 stores the data. In the succeeding frame FR(k+1), the frame memory 31 outputs the stored data D(i,j,k) as the video data D0(i,j,k) for the current frame FR(k). In the succeeding frame FR(k+1), the frame memory 31 outputs the stored data D0(i,j,k−1) as the video data D00(i,j,k−1) for the previous frame FR(k−1).

For the present exemplary embodiment, an merely to use as an example, the bit depth of the video data D00(i,j,k−2) for the previous frame FR(k−2) may be 4 bits, and bit depth of the video data D0(i,j,k−1) for the current frame FR(k−1) may be 6 bits, respectively. Under these conditions, the frame memory 31 requires only 30 bits to store all RGB (red, green, blue) data. Therefore, a general purpose memory (with a 2n bit width) with a sufficient capacity for the video data D0(i,j,k−1) for the current frame FR(k−1) has an enough capacity to store both the video data D0(i,j,k−1) for the current frame FR(k−1) as well as the video data D00(i,j,k−2) for the previous frame FR(k−2).

Figure 6:
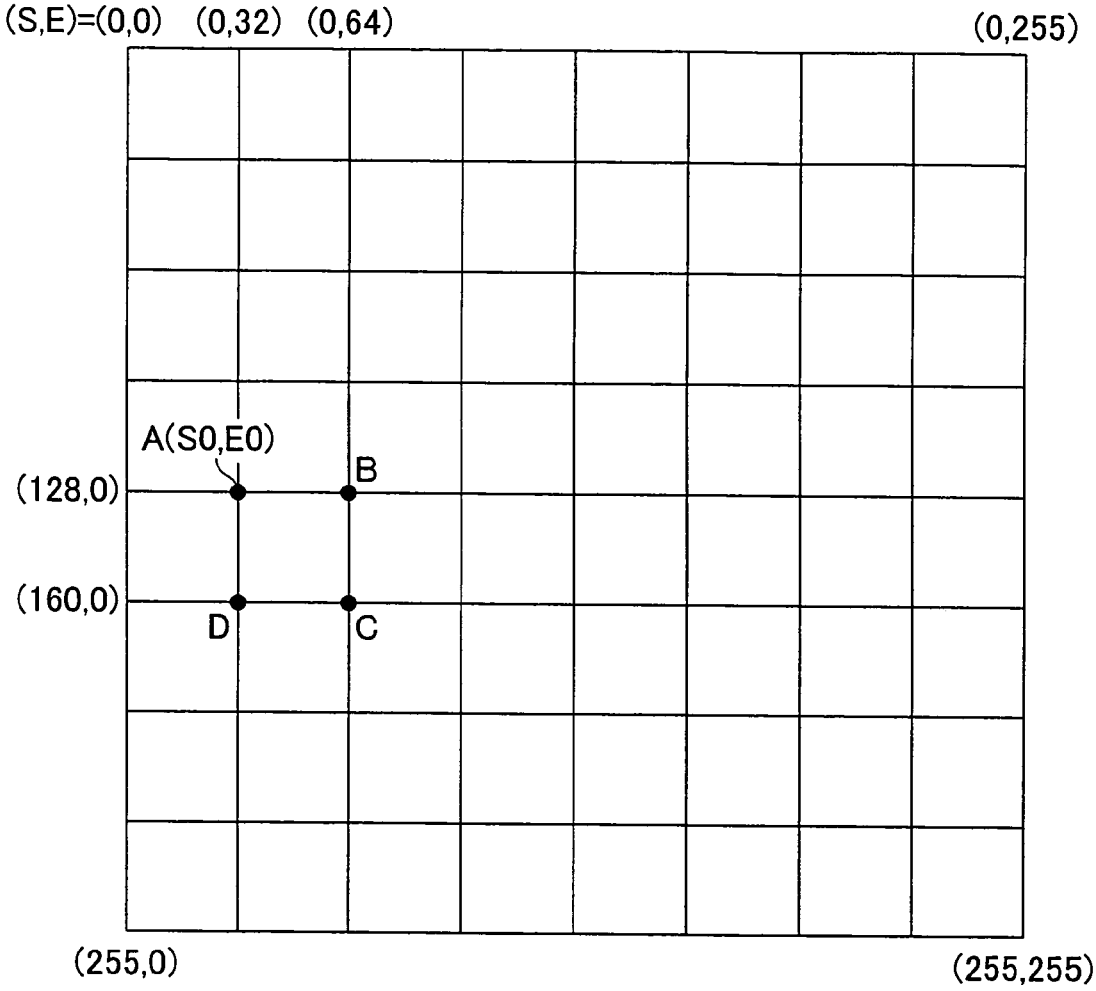
FIG. 6 is a drawing showing a relationship between areas and calculation blocks expressed in terms of a combination of video data for a previous frame and a current frame, in accordance with an exemplary embodiment of the present invention.

FIG. 6 is a drawing showing a relationship between areas and calculation blocks expressed in terms of a combination of video data for a previous frame and a current frame, in accordance with an exemplary embodiment of the present invention. FIG. 7 illustrates content of an exemplary lookup table provided to the modulated-drive processing section, in accordance with an exemplary embodiment of the present invention. Reference is made to both FIGS. 6 and 7 for the following discussion.

FIG. 6 is a graphical, two-dimensional representation of the combination of possible grayscale levels. The graph is shown divided into 8×8 calculation blocks. As shown in FIG. 6, the LUT 41 contains actual grayscale levels at the four corners of each calculation block (9×9=81 points). Note that FIGS. 6 and 7 show start grayscale levels (grayscale levels for the previous frame) along the vertical axis (in columns) and end grayscale levels (grayscale levels for the current frame) along the horizontal axis (in rows). The values shown increase toward the lower right corner. Intended for use with 256 grayscale levels, FIGS. 6, 7 contain an actual grayscale level for every 32 grayscale levels.

The values in FIG. 7 represent an example where the pixel PIX(i,j) is a liquid crystal element operating in vertical align, normally black mode. Liquid crystal elements operating in that mode are slower to respond to a falling grayscale level transition than to a rising grayscale level transition. When applied to a falling transition, a universal previous-to-current grayscale level transition facilitation is often unsuccessful, resulting in a difference between an actual grayscale level transition and a desired grayscale level transition. So, the blocks in which the actual value is much greater than the desired value (E) occupies a much larger portion of the table (indicated as α1) than those in which the actual value is much smaller than the desired value (indicated as α2). The portions α1, α2 show actual grayscale levels which are easily recognized by the user as being different from the video data D(i,j,k) if the modulation processing section 33 corrects the video data D(i,j,k) for the next frame FR(k) on the basis of the video data D(i,j,k−1) for the current frame FR(k−1), with no correction executed by the current frame grayscale level correction circuit 34.

The computing circuit 42 receives a combination (S,E) of the video data D00(i,j,k−2) and D0(i,j,k−1) and identifies a calculation block to which the input combination (S,E) belongs.

Let A, B, C, D indicate the actual grayscale levels at the four corners (i.e., upper left, upper right, lower right, and lower left corners respectively) of the calculation block; Y×X the area of the calculation block; and (Δy, Δx)=((S-S0)/Y,(E-E0)/X) a (1,1) normalized difference between the combination (S0,E0) in the upper left corner and the above combination (S,E).

If Δx≧Δy, the computing circuit 42 retrieves the actual grayscale levels A, B and C from the LUT 41 to calculate D0*a*(i,j,k−1) as in Equation (1):

$$D0a(i,j,k-1)=A+\Delta x\times(B-A)+\Delta y\times(C-B) \quad (1)$$

If Δx<Δy, the computing circuit 42 retrieves the actual grayscale levels A, C and D from the LUT 41 and calculates the D0*a*(i,j,k−1) as in Equation (2):

$$D0a(i,j,k-1)=C+\Delta x\times(C-D)+(1-\Delta y)\times(D-A) \quad (2)$$

In the example illustrated in FIGS. 6 and 7, for (S,E)=(144, 48), calculation blocks (128, 32), (128, 64), (160, 64), and (160, 32) are identified, and the corrected video data D0*a*(i,j,k−1) for the current frame FR(k−1) is 70. Since the video data D(i,j,k) is corrected in accordance with the corrected current video data D0*a*(i,j,k−1)=70, excess brightness does not occur. This would not be the case, if the modulation processing section 33 corrected the video data D(i,j,k) for the next desired frame FR(k) in accordance with the actual video data D0(i,j,k)=48 for the current frame FR(k−1), with no correction executed by the current frame grayscale level correction circuit 34.

The description above assumed, as an example, that the bit depth (bit width) of the actual grayscale levels contained in the LUT 41 is equal to that of the video data D(i,j,k), that is, 8 bits. However, if there is demand for reduction in storage capacity of the LUT 41, the bit depth (bit width) of the actual grayscale levels contained in the LUT 41 may be specified to be equal to or less than one of the bit depth of the video data D00(i,j,k−2) for the previous frame FR(k−2) and that of the video data D0(i,j,k−1) for the current frame FR(k−1). When D00(i,j,k−2) and D0(i,j,k−1) have the same bit depth, the bit depth for the LUT 41 is specified to that value.

In this arrangement, the bit depth (bit width) of the actual grayscale levels contained in the LUT 41 is also specified to be equal to the number of significant digits in the computation based on the previous and the current video data, that is, the smaller bit width. The arrangement is thus capable of reducing the required capacity with the LUT 41 to a minimum under the conditions that it does not adversely affect computing accuracy.

Accordingly, the image display 1 as described above in accordance with the present exemplary embodiment may improve pixel response speed by facilitating a transition from a current grayscale level to a desired grayscale level. The image display 1, using relatively small circuitry, may also prevent a large gap from developing between a next actual pixel grayscale level and a next desired pixel grayscale level as indicated by video data, due to (a) synergism of poor pixel response in the grayscale level transition from a previous (before first) frame to a current (first) frame; and/or (b) inappropriate grayscale level transition facilitation from the current frame to the next desired frame. Therefore, the image display 1 may substantially reduce and/or possibly prevent the excess brightness or poor brightness caused by the gap.

Embodiment 2

The foregoing description illustrated an example where it is the current frame grayscale level correction circuit 34 that corrects the current frame video signal DAT0. This is not the case with the modulated-drive processing section 21*a* in accordance with the present exemplary embodiment. In this exemplary embodiment, a current frame grayscale level correction circuit 34*a* generates a predicted value D0*a*(i,j,k−1) for purposes of comparison. For example, if the predicted value D0*a*(i,j,k−1) (this is the corrected current video data determined based on the current frame video data D0(i,j,k−1) and the previous frame video data D00(i,j,k−2), as described above) differs from the actual current video data D0(i,j,k−1) for the current frame FR(k−1) by at least a given threshold value(where the given threshold may be an absolute value, for example), the current frame grayscale level correction circuit 34*a* outputs the predicted value D0*a*(i,j,k−1); otherwise the current frame grayscale level correction circuit 34*a* outputs the current frame video signal DAT0 to modulation processing section 33.

An exemplary threshold value may be set so as to be about four grayscale levels, for example, for video data D(i,j,k) representing 8-bit grayscale. Alternatively, considering the fact that there may be various factors adversely affecting prediction accuracy, including quantization noise, the threshold value may be between about 4-16 grayscale levels, or perhaps to a grayscale level other than described that is set based on other factors.

The grayscale level of the pixel PIX(i,j) in the current frame FR(k−1) is sufficiently closer to that the grayscale level indicated by the video data D0(i,j,k−1) for the current frame FR(k−1) when the predicted value differs from the actual current video data D0(i,j,k−1) by a relatively small amount, than when it differs by a relatively large amount. So in the former case, excess or poor brightness is unlikely to occur, even if the modulation processing section 33 corrects the video data D(i,j,k) for the next desired frame FR(k) based on the actual current video data D0(i,j,k−1), or uncorrected current data. In other words, no correction of the current video data is performed by grayscale level correction circuit 34*a*. This is because even if excess or poor brightness occurs, it should not be serious. Besides, prediction error is larger when the predicted value differs from the targeted value (the targeted value being embodied as the actual current video data D0(i,j,k−1) for the current frame FR(k−1), for example) by a relatively small amount than when it differs by a relatively large amount, as discussed above. Thus, in the former case, changes in grayscale level due to prediction error are easily spotted by the user, when the modulation processing section 33 facilitates the grayscale level transition.

On the other hand, in cases or situations where the predicted value differs from the targeted value D0(i,j,k−1) by a relatively large amount, excess or poor brightness may likely occur, unless the current frame video signal DAT0 is corrected. In addition, prediction error is smaller, and even with the current frame video signal DAT0 being corrected, changes in grayscale level due to prediction error are infrequently spotted (or barely perceptible visually) by the user.

In the present exemplary embodiment, the current frame grayscale level correction circuit 34*a* does not correct the current frame video signal DAT0 if the predicted value differs from the targeted value D0(i,j,k−1) by an amount which is less than the threshold value. In other words, this is a situation in which excess or poor brightness does not likely occur, even without correcting the current frame video signal DAT0, and/or possibly a situation where correcting the current frame video signal DAT0 may actually degrade display quality in the event of a prediction error. The current frame grayscale level correction circuit 34*a* thus corrects the current frame video signal DAT0 when excess or poor brightness would likely occur without correcting the current frame video signal DAT0. This may prevent excess or poor brightness from occurring, while at the same time help to restrain display quality degradation in the event that a prediction error occurs.

Embodiment 3

The previous exemplary embodiment [Embodiment 2] illustrated an arrangement where the current frame grayscale level correction circuit 34*a* determines correction needs based on a difference between a predicted value and a targeted value. The present exemplary embodiment describes an arrangement where a LUT is prepared in advance containing information on correction needs, the information being referred to by the current frame grayscale level correction circuit 34 for determining a resultant value to apply to modulation processing section 33 in order to correct the video data D(i,j,k) for the next desired frame FR(k).

FIG. 8 illustrates content of another exemplary lookup table provided to the modulated-drive processing section, in accordance with an exemplary embodiment of the present invention. As shown in FIG. 8, portions α1 and α2 of a LUT 41*b* in accordance with the present exemplary embodiment contain LUT information similar to what was shown in FIG. 7. As described previously with respect to FIG. 7, the portions α1 and α2 are occupied by actual grayscale levels differing from the next desired video data D(i,j,k) by such an amount that the user would easily spot changes, if the modulation processing section 33 corrected the video data D(i,j,k) for the next frame FR(k) based on the actual current video data D(i,j,k−1) for the current frame FR(k−1); this is the case where no correction is performed by the current frame grayscale level correction circuit 34. The rest of the table, or the portion α3, contains target values (E) per se.

For this exemplary embodiment, the computing circuit 42*b* shown in FIG. 3 receives a combination (S,E) of the previous video data D00(i,j,k−2) and current video data D0(i,j,k−1) input thereto from control circuit 32. The computing circuit 42*b* then identifies a calculation block to which the input combination (S,E) belongs, and retrieves a given one of the actual grayscale levels A-D for the four corners of the calculation block (see FIG. 6, for example). The computing circuit 42*b* decides whether the actual grayscale level matches the target value, that is, whether the identified calculation block is in the portion α3. A decision is made through another decision as to whether the actual grayscale level matches the grayscale level on the border of the calculation blocks. If the actual grayscale level is determined as belonging to portion α3, the computing circuit 42*b* does not correct the current frame video signal DAT0. The computing circuit 42*b* corrects the current frame video signal DAT0 when it has determined that the actual grayscale level for the input combination (S,E) belongs to either portion α1 or α2.

The arrangement of the present exemplary embodiment thus may permit achievements similar to that described in Embodiment 2: the current frame video signal DAT0 is not corrected if it is likely that excess or poor brightness does not occur and also that display quality is degraded in the event of prediction error. The current frame video signal DAT0 is corrected only if excess or poor brightness is likely to occur.

Embodiment 4

The present exemplary embodiment will describe a current frame grayscale level correction circuit 34*c* that may correct based on temperature. As will be seen below, the present exemplary embodiment may be applicable to any of the previously described exemplary embodiments.

Figure 9:
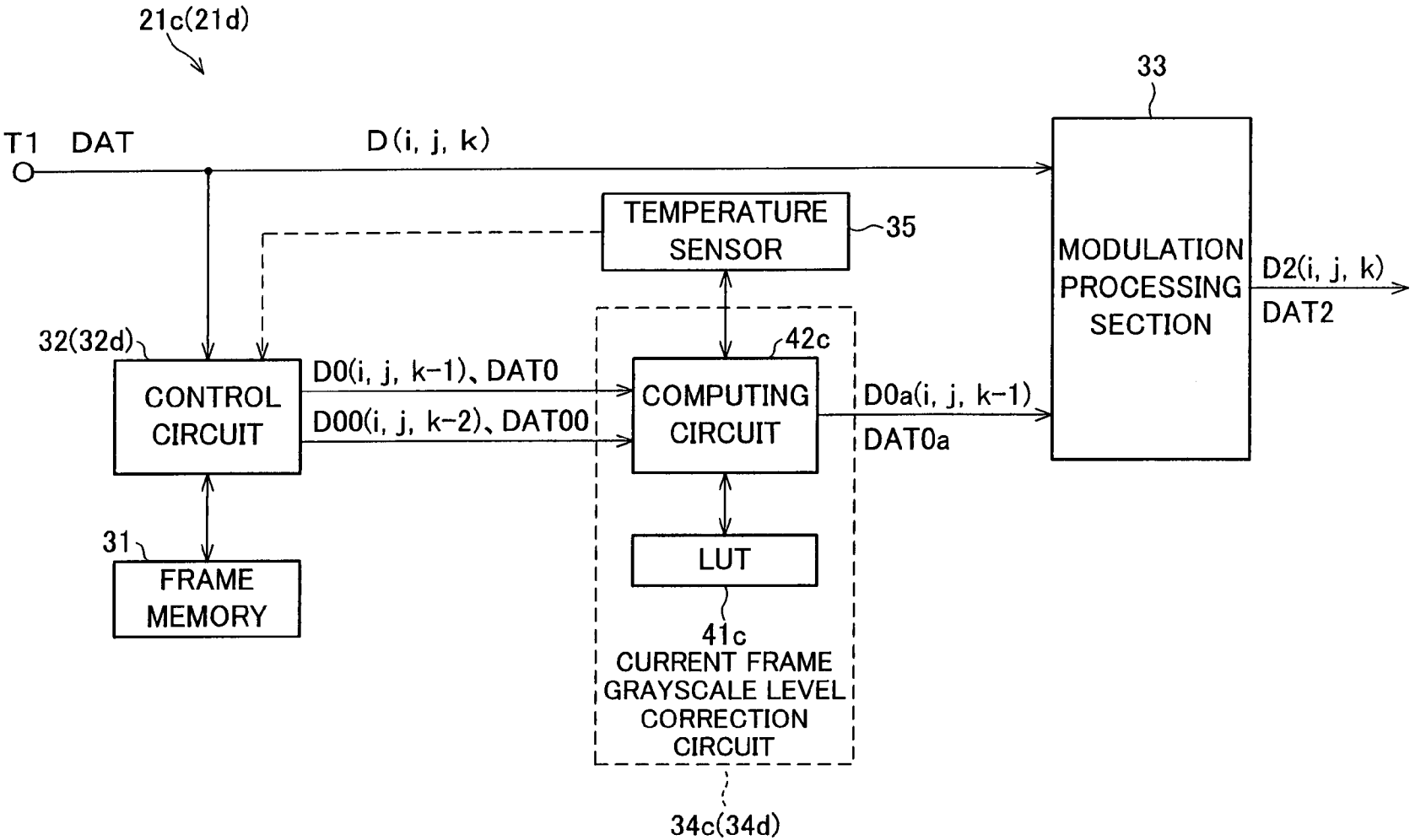
FIG. 9 is a block diagram of part of a modulated-drive processing section in accordance with another exemplary embodiment of the present invention.

FIG. 9 is a block diagram of part of a modulated-drive processing section in accordance with another exemplary embodiment of the present invention. Referring to FIG. 9, a modulated-drive processing section 21*c* has the same arrangement as described in Embodiment 3, but additionally includes a temperature sensor 35 for sensing the temperature of the pixels PIX. The temperature may be taken into consideration when a current frame grayscale level correction circuit 34*c* determines whether to correct current video data D0(i, j, k−1) for the current frame FR(k−1) to output the corrected current video data D0*a* (i, j, k−1) to the modulation processing section 33, in response to a combined input of the current video data D0(i, j, k−1) for the current frame FR(k−1) and the previous video data D00(i, j, k−1) for the previous frame FR(k−2), as shown in FIG. 9.

The current frame grayscale level correction circuit 34*c* may include multiple LUTs 41*c*, where each LUT 41*c* may be adapted or configured for a different given temperature range. Each LUT 41*c* contains grayscale level values that have been actually reached for the associated temperature range, similarly to the LUT 41.

A computing circuit 42*c* in the current frame grayscale level correction circuit 34*c* may select one of the LUTs 41*c* to be referred to in interpolation, based on the temperature information received from the temperature sensor 35. The computing circuit 42*c* and a computing circuit 42*e* (to be described in further detail below) may be understood as a kind of controller or 'control section' for selecting a desired LUT 41*c*, for example.

Under these conditions, assume, for example, that the pixels PIX are liquid crystal elements of which the response speed varies with temperature. If the current frame grayscale level correction circuit 34*c* does not perform correction, excess or poor brightness may occur, depending on the correction for the video data D of the next desired frame that is applied by the modulation processing section 33.

According to the present exemplary embodiments as shown in FIG. 9, however, the current frame grayscale level correction circuit 34*c* is capable of correcting the current frame video signal DAT0 in accordance with the current temperature of the pixels PIX, even if the response speed of the pixels PIX has changed with temperature, so that the correction should be adjusted to prevent excess or poor brightness. This may desirably prevent excess or poor brightness from occurring at any temperature.

Further, the current frame grayscale level correction circuit 34*c* may terminate the correction for the current frame video signal DAT0 when temperature rises to a given temperature range. Therefore, at relatively high temperatures where the pixel PIX(i,j) responds at sufficient speed to no longer cause excess or poor brightness due to poor response, the modulation processing section 33 corrects frame video signal DAT to output a corrected DAT2 signal based on the uncorrected current frame video signal DAT0 and the video signal DAT, so as to facilitate a grayscale level transition from the current frame to the next desired frame.

This prevents the current frame grayscale level correction circuit 34*c* from unnecessarily restraining a grayscale level transition, which could reduce overall response speed of the image display 1, at temperatures where excess or poor brightness does not actually occur due to poor response.

The above description selected one of the LUTs 41*c*. Actual values however may monotonically change with temperature. The computing circuit 42*c* retrieves one actual value from each of two LUTs 41*c* where the temperature ranges are closest to the currently temperature sensed by temperature sensor 35, and interpolates between the actual values to calculate an actual value for the current temperature. Such an arrangement may therefore employ fewer LUTs 41*c*, but is still capable of preventing excess or poor brightness from occurring with greater accuracy.

Embodiment 5

The present exemplary embodiment will describe altering the bit width of the video data D00(i,j,k−2) for the previous frame, and altering bit width of the video data D0(i,j,k−1) for the current frame, based on temperature, for storage in the frame memory 31. The arrangement described herein is applicable to any of the previous exemplary embodiments and will be described with respect to FIG. 9.

Referring again to FIG. 9, in a modulated-drive processing section 21*d* in accordance with the present exemplary embodiment, a control circuit 32*d* may alter the bit width of the video data D00(i,j,k−2) for the previous frame and the bit width of the video data D0(i,j,k−1) for the current frame for storage in the frame memory 31, based on results of sensing by the temperature sensor 35. For example, the bit width of the video data D00(i,j,k−2) for the previous frame may be increased as temperature decreases to a value that is low in a given temperature range. This increase in the bit width of the video data D00(i,j,k−2) for the previous frame may be offset by a corresponding decrease in the bit width of the video data D0(i,j,k−1) for the current frame, for example.

The total bit width of the video data D00(i,j,k−2) and D0(i,j,k−1) in the frame memory 31 may be limited to a given value (for example, 10 bits) in order to reduce the required storage capacity of the frame memory 31. The bit widths of the previous video data D00(i,j,k−2) and current video data D0(i,j,k−1) may be thus specified so that the video data D0(i,j,k−1) for the current frame may be corrected in a substantially appropriate or accurate way. Meanwhile, the grayscale level reached by the pixel PIX(i,j) in a grayscale level transition from the previous frame to the current frame may become increasingly susceptible to the video data for the previous frame, with any decrease in response speed of the pixel PIX(i,j). Accordingly, a desired or improved bit width designation for the video data D00(i,j,k−2) and D0(i,j,k−1) may change with temperature.

When the response speed of the pixels PIX, and hence optimal bit width designation change with temperature, the current frame grayscale level correction circuit 34*d* (as shown in FIG. 9, for example) adjusts the bit width designation for the video data D00(i,j,k−2) and D0(i,j,k−1) based on this temperature change. For example, and based on the temperature of the current pixels PIX, bit width of the video data D00(i,j,k−2) for the previous frame may be increased if the temperature change indicates a decrease in temperature. This may ensure suitable bit width designation and accurate correction of the video data D0(i,j,k−1) at any temperature. Excess or poor brightness is hence prevented from occurring more appropriately.

Supposing that the total bit width for the previous video data and current frame video data is 10 bits (as in the aforementioned example). The bit width of the previous video data D00(i,j,k−2) for the previous frame may be set to 3 bits at ordinary temperatures, 2 bits at higher temperatures, and 4 bits at lower temperatures, for example.

If the computing circuit 42*c* (or 42-42*b*) is supposed to refer to the LUT 41*c* (or 41, 41*b*) to generate the corrected current video data D0*a* (i, j, k−1), but there is such a strong demand for reduction in storage capacity of the LUT that Δy cannot be calculated in Equations (1), (2) for the smallest bit width of the previous video data D00(l,j,k−2), the computing circuit 42 may then calculate the corrected current video data D0*a*(i,j,k−1) based on only the two lower-value corners (C and D) of the calculation block (see FIG. 6, for example) corresponding to the previous video data D00(i,j,k−2). When the bit width of the previous video data D00(l,j,k−2) is so insufficient that a calculation block cannot be identified, the computing circuit 42 may just calculate the corrected video data D0*a*(i,j,k−1) on the basis of the two corners of the calculation block A, B, C, D that correspond to the lowest-value previous video data D00(i,j,k−2).

For example, and as shown in FIGS. 7, 8, suppose that a combination (S,E) of the previous video data D00(i,j,k−2) and the current video data D0(i,j,k−1)is divided into 8×8 calculation blocks, and that the actual values at the four corners of the calculation blocks are stored in the LUT 41*c*. If the bit width of the previous video data D00(i,j,k−2) decreases to 3 bits, calculation blocks may be able to be identified, but Δy cannot be calculated (which is always 0). When this is the case, the computing circuit 42*c* calculates the corrected video data D0*a*(i,j,k−1) based only on corners C and D. If the bit width for the previous video data D00(i,j,k−2) decreases to 2 bits (perhaps due to higher temperatures as discussed above), calculation blocks can no longer be identified. For example, and as may be shown by FIG. 6, (S,E)=(160,48) corresponds to both a calculation block with corners (128, 32), (128, 64), (160, 64), and (160, 32) and another calculation block with corners (160, 32), (160, 64), (192, 64), and (192, 32). In this case, the computing circuit 42*c* calculates the corrected current video data D0*a*(i,j,k−1) on the basis of (192, 64) and (192, 32) of the actual values at the four corners.

Here, of the actual values stored in the LUT 41*c*, actual values corresponding to the previous video data D00(i,j,k−2) are lower. In addition, the user can more easily spot excess brightness caused by too large corrected current video data D0*a*(i,j,k−1) than poor brightness caused by too small corrected current video data D0*a*(i,j,k−1).

Therefore, degradation of display quality of the image display 1 becomes less recognizable, as the computing circuit 42*c* may calculate the corrected video data D0*a*(i,j,k−1) on the basis of the two corners (C and D) corresponding to the lower 2-bit value for the previous video data D00(i,j,k−2).

Embodiment 6

The foregoing exemplary embodiments have presumed that the LUT 41 (41*b*, 41*c*) stores actual values. The exemplary embodiments of the present invention are not limited to these examples, however. As mentioned earlier, occurrences of excess brightness primarily degrade display quality. Accordingly, to reliably prevent excess brightness from occurring, the LUT 41 may store grayscale levels greater than actual values so that when the current frame video signal DAT0 needs be corrected, the current frame grayscale level correction circuit 34 (34*a*-34*d*) can correct the current frame video signal DAT0 to grayscale levels greater than actual values.

A LUT that stores grayscale levels greater than actual grayscale level values may help to restrain grayscale level transition facilitation from the current frame to the next frame, then in a case when actual values are stored in the LUT. Excess brightness may thus possibly be prevented from occurring with even more certainty.

The correction determined by the current frame grayscale level correction circuit 34 (34*a*-34*d*) may be altered based on the type of video. Such an arrangement may be applicable to any of the foregoing exemplary embodiments.

Figure 10:
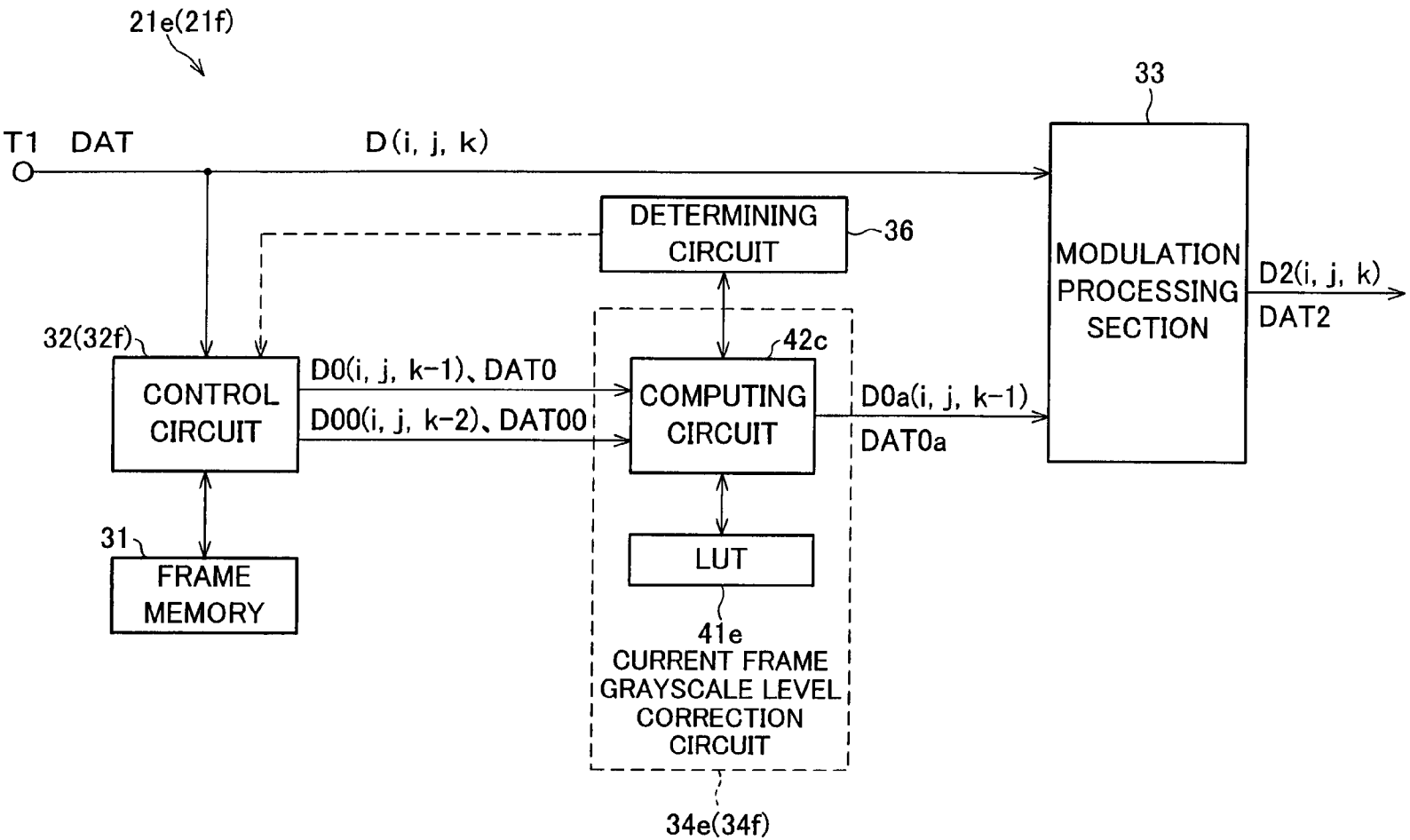
FIG. 10 is a block diagram of part of a modulated-drive processing section in accordance with another exemplary embodiment of the present invention.

FIG. 10 is a block diagram of part of a modulated-drive processing section in accordance with another exemplary embodiment of the present invention. The modulated-drive processing section 21*e* of FIG. 10 is arranged in the same manner as described in Embodiment 3 above, but includes a determining circuit 36 for determining the type of video. Having received a combination of video data for the previous frame D00 and video data D0 for the current frame, the current frame grayscale level correction circuit 34*e* may either output the uncorrected or actual current video data D0, or determine a corrected current video data D0*a* (based on previous video data D00 and current video data D0) to be output to modulation processing section 33, depending on a decision received from the determining circuit 36.

For example, the current frame grayscale level correction circuit 34*e* may include LUTs 41*e*, each LUT 41*e* corresponding to a given temperature range. Similarly to LUT 41 in FIG. 3, each LUT 41*e* stores actual values of video of an associated type. On the other hand, the computing circuit 42*e* of the current frame grayscale level correction circuit 34*e* in FIG. 10 selects one of the LUTs 41*e* (to which reference will be made in interpolation), based on video type information received from determining circuit 36.

Here, as mentioned earlier, in the case when the current frame video signal DAT0 needs be corrected to grayscale levels greater than actual values, if the current frame grayscale level correction circuit 34*e* corrects the signal excessively upwards, excess brightness can be prevented from occurring with some certainty, but at the expense of reduced response speed. Therefore, a desired difference between a correct value and an actual value may be set so as to restrain excess brightness occurrence within a given range, so that decreases in response speed are not easily recognizable. Nevertheless, the desired difference may vary depending on the type of video. Therefore, if various types of video is input with a fixed difference, it may be difficult to set the difference to a desired value that is suitable for all video types.

In contrast, the modulated-drive processing section 21*e* of FIG. 10 may alter the difference between a correct value and an actual value based on the type of video, since it receives video type information from determining circuit 36. Therefore, excess brightness occurrence can be restrained for input of an type of video, i.e., fast-moving or slow-moving video, so that decreases in the response speed are not easily recognized by the user.

Further, the current frame grayscale level correction circuit 34*e* may cease correcting the current frame video signal DAT0 if the video type indicates that the video includes slow movements (where excess or poor brightness would not occur due to poor response even without the current frame grayscale level correction circuit 34*e* correcting the current frame video signal DAT0). This may prevent the current frame grayscale level correction circuit 34*e* from unnecessarily restraining a grayscale level transition when the displayed video includes slow movements. Decrease in the response speed of the image display 1 may thus be avoided.

Embodiment 7

The present exemplary embodiment will describe an arrangement in which bit width of the previous video data D00(i,j,k−2) for the previous frame and bit width of the current video data D0(i,j,k−1) for the current frame may be altered in accordance with video type, for storage in frame memory 31. The arrangement of the present embodiment is applicable to any of the foregoing first through sixth embodiments. In the following description, it will be applied to the fourth embodiment.

A modulated-drive processing section 21*f* in accordance with the present exemplary embodiment, may include a control circuit 32*f* that may alter the bit width of the previous video data D00(i,j,k−2) for the previous frame and the bit width of the current video data D0(i,j,k−1) for the current frame stored in the frame memory 31 based on video type information received from determining circuit 36 (see dotted line between determining circuit 36 and control circuit 32*f*). When the video type includes relatively fast movements, the modulated-drive processing section 21*f* increases the bit width of the previous video data D00(i,j,k−2) for the previous frame and decreases, by an amount which may correspond to the amount of increased bit width, the bit width of the current video data D0(i,j,k−1) for the current frame.

Here, to reduce the storage capacity of the frame memory 31, the total bit width of the video data D00(i,j,k−2) and D0(i,j,k−1) stored in the frame memory 31 may be restricted to a given bit width (for example, 10 bits). In addition, the bit widths of the video data D00(i,j,k−2) and D0(i,j,k−1) may be determined so as to adequately correct the current video data for the current frame (shown as D0*a*(i, j, k−1) in FIG. 10. On the other hand, the grayscale level reached by the pixel PIX(i,j) in a grayscale level transition from the previous frame to the current frame may be more susceptible to the video data for the previous frame when the input is fast moving video. Therefore, when the video type, and hence when the expected speed of movements change, a desired designation of the bit widths for the previous and current video data D00(i,j,k−2) and D0(i,j,k−1) may also change.

Thus, when the video type (and hence desired bit designation) changes, the current frame grayscale level correction circuit 34*f* may alter the designation of bit widths for the video data D00(i,j,k−2) and D0(i,j,k−1) based on the video type. That is, when the video type indicates relatively fast movements, the bit width of the video data D00(i,j,k−2) for the previous frame is increased. This enables the bit widths to be suitably designated, and the video data D0(i,j,k−1) to be corrected with desired accuracy, regardless of the type of video. Therefore, excess brightness or poor brightness occurrence may be more prevented with more accuracy and efficiency.

The exemplary embodiments above have been described where the display element is a liquid crystal cell of a vertical align, normally black mode. The exemplary embodiments of the present invention, are not limited to these examples, however. For example, the same effects may be substantially achieved for any kind of display element configuration that develops a difference between an actual grayscale level transition and a desired grayscale level transition, in an effort to avoid slow response speed that may occur even when modulation/driving techniques are employed to facilitate the grayscale level transition in a previous-to-current grayscale level transition.

The response speed of the liquid crystal cell of vertical align, normally black mode may be slower in a falling grayscale level transition than in a rising transition. A difference between an actual grayscale level transition and a desired grayscale level transition, and hence excess brightness, may occur even with such modulation/driving to facilitate the grayscale level transition in a previous-to-current falling grayscale level transition. Therefore, the exemplary embodiments of the present invention may be especially suitable for avoiding or preventing the occurrence of excess brightness.

The exemplary embodiments have been described in terms of the members or components forming the modulated-drive processing section(s) being embodied as hardware. The exemplary embodiments of the present invention are not limited to a hardware configuration, however. All or some of the components may be embodied by a combination of computer programs realizing the aforementioned functions and hardware (such as a computer) executing the programs.

For example, a computer may be connected to the image display 1 as a driver driving the image display 1. Thus, a computer may effectively replace the modulated-drive processing sections (21-21*f*). In addition, the modulated-drive processing section may be provided in the form of a peripheral or built-in conversion board to the image display 1. If the operation of the circuit acting as the modulated-drive processing section can be changed by rewriting a firmware or like program, the software may be distributed to change the operation of the circuit so that the circuit operates as the modulated-drive processing section of the exemplary embodiments. In these cases, if hardware is prepared which is capable of executing the aforementioned functions, executing the program on the hardware alone realizes the modulated-drive processing sections in accordance with the embodiments.

Further, although the above detailed description has described at least one method for storing the current video data D0(i, j, k−1) of the current frame FR(k−1) and previous video data D00(i, j, k−2) of the previous frame FR(k−2) in the frame memory 31, in an effort to conserve space or use less memory, the exemplary embodiments may employ several alternative storage methods. For example, the following provide alternative exemplary storage techniques that may be used singly or in combination which other techniques to save memory space, depending on the desired accuracy or desired precision, for example, and perhaps accounting for a desired circuit complexity, for example.

1. Bit Cutting

Where bit cutting is employed, only necessary high order bits are recorded (stored), by cutting off the low order bits beyond required precision. This is a reasonably straightforward and simple approach to saving memory space. For example, grayscale levels 0, 32, 64, 96, 128, 160, 192, 224 may be recorded using 0 through 7, i.e., 3 bits. Selecting necessary bits requires a negligible added circuit complexity. The exemplary embodiments of the present invention, although adaptable for employing this approach, are not limited to bit cutting.

2. Indexing

For example, grayscale levels 0, 2, 4, 8, 16, 32, 64, 128 can be indexed using 3 bits (0 through 7) by paying attention to the position of the non-zero highest order bit. Generally, grayscale level errors are increasingly visible toward the lower end of grayscale. The use of the index in recording grayscale levels may enable the grayscale levels to be recorded in more detail in a region where errors are more likely to be visible. Generally, allocation is based on rules to prevent increased circuit complexity. Dividing may be accomplished in any given manner in combination with suitable selection of conditions, provided that efficiency does not suffer.

3. Hashing, Huffman Coding and other Dictionaries

This approach is similar to indexing. When it is expected that the grayscale level information to be recorded has a distinct tendency in occurrence, memory space can be saved by indexing, using a small bit width, grayscale levels which are more likely to occur. A translation system may be needed for both directions: recording and retrieval.

4. Translation

Data to be recorded may be subjected to a suitable translation in order to efficiently implement the above approaches. A typical example is the translation of an RGB grayscale level signal into a brightness signal and color difference signal. Recording the color difference signal by indexing (see 2. above) may substantially prevent deterioration of grayscale level information. Other suitable translations may include those based on an RGB mean value, as well as translation based on differences from that RGB mean value.

5. Compression

For circuits that have relatively loose restrictions regarding their desired complexity, general compression methods may be used. The compression approach may substantially improve memory use efficiency. Known compression methods include those carried out using run length after suitable data conversion, and encoding methods. Suitable data conversion methods may include, in addition to the foregoing methods, frequency conversions (cosine transform, Fourier transform), differential conversions based on the current data, and other publicly known methods in the field of image processing (jpeg, mpeg conversion), for example. These methods may be selectively used alone or in a combination with one or more methods.

Selecting the appropriate compression for current video data and for previous video data may improve recording efficiency. This advantage should be weighed against how much additional circuit complexity is acceptable, as well as the possibility of increased circuit operating frequency. An appropriate choice may be made taking into account the above trade-offs between the use of the display, the desired precision for recording, and the desired amount circuit complexity, for example; other additional factors could also be considered.

A method of driving a display in accordance with an exemplary embodiment of the present invention may include determining a resultant value based on a first drive signal input at a first time and a previous drive signal input at a time previous to the first time, and modulating a second drive signal, input at a second time that is subsequent to the first time, based on the determined resultant value to produce a corrected second drive signal for a pixel, so as to facilitate a tone transition from the first time to the second time.

If a previous-to-current grayscale level transition is a given grayscale level transition, when next desired video data of the second drive signal is corrected using the resultant value to facilitate a current-to-next grayscale level transition, the correction amount may be restrained more than without correction in the determining step.

For example, when a previous-to-next grayscale level transition is a "fall" followed by a "rise" or a "rise" followed by a "fall," if a correction is done in the modulating step, excess or poor brightness may occur due to a next pixel grayscale level differing greatly from the grayscale level (as indicated by the next video data). The difference is in turn caused by a poor pixel response in the previous-to-current grayscale level transition, plus a grayscale level transition facilitation in the modulating step. Even in such situations, the exemplary embodiments may prevent excess or poor brightness from occurring to improve display quality of the display, by restraining a correction amount in the modulating step.

Meanwhile, video data which is yet to be corrected (uncorrected data) may be stored for the determining step. Therefore, unlike an arrangement where only corrected video data is stored, errors do not accumulate. This may enable the use of relatively small circuitry to be used without the pixel grayscale level control diverging or oscillating. As a result, a good quality display using relatively small circuitry may be provided.

The previous and current video data that is stored in frame memory 31 may have the same bit width as the next desired video data (i.e., D(i, j, k)). If there is a special demand to reduce circuit size, however, the stored previous video data and current video data may have a combined bit width set to a desired value that is less than twice the bit width of the next video data. The previous video data may have a bit width less than or equal to that of the stored current video data.

Further, a restricted bit width may be stored in frame memory 31, so that the combined bit width assumes the desired value. Accordingly, previous and current video data may be stored in a memory at limited bit widths, allowing reductions in circuit size, for example.

Additionally, a ratio of the bit width of the previous video data to the desired value may be altered in accordance with a video type and/or temperature.

Here, if the set value is restricted to a smaller value than the bit width of the next video data, increasing the ratio of the bit width of the previous video data to the set value too much may cause the corrected current video data (i.e., resultant value) to more accurately reflect the effects of the previous video data, but not the effects of the current video data. Therefore, the ratio of the bit width of the previous video data to the set value may be set to a suitable value based on the effects of both kinds of video data (previous and current) that may have a greater effect when the input is fast moving video. Therefore, when the video type, and hence the expected speed of movement changes, the suitable value for the ratio may change. Similarly, when temperature, and hence pixel response speed, changes, the suitable value for the ratio may also change.

In the exemplary embodiments, the ratio of the bit width of the previous video data to the desired value may be altered in accordance with a video type and/or temperature. Therefore, the ratio may be maintained at a suitable value, regardless of a video type or temperature. As a result, the display may be capable of maintaining a high level of display quality.

Further, if the corrected current video data differs from the uncorrected current video data by an amount smaller than a given threshold value, the next video data may be modulated (corrected) with reference to the uncorrected current video data.

In accordance with the exemplary embodiments, if the corrected current video data differs from the uncorrected current video data by an amount smaller than a given threshold value, that is, if excess or poor brightness is unlikely to occur without correcting the current video data, and with the current video data corrected, display quality is likely to be degraded upon an error occurrence in correction, the next video data may be corrected with reference to the uncorrected current video data, not the corrected current video data. As a result, excess or poor brightness occurrences are prevented while restraining display quality from being degraded due to an error in correction in the second correcting step.

Instead of comparison to the threshold value, the determining step of the exemplary method may correct the current video data if the combination of the previous video data and the current video data is a given combination. With such an arrangement, if the combination is predicted so as to have likelihood of causing excess or poor brightness, the current video data is corrected. As a result, excess or poor brightness occurrences may be prevented while restraining display quality from being degraded due to an error in correction in the second correcting step.

Further, the determining step may also alter a given combination and/or a correction amount in accordance with temperature. Here, a change in temperature changes pixel response speed, and hence suitable correction amounts and combinations for which excess or poor brightness occurrences are predicted. In an exemplary embodiment of the present invention, at least either one of the correction amount and the combination given as the combination for which correction is made is altered in accordance with temperature. As a result, regardless of temperature, excess or poor brightness occurrence may be adequately prevented, and high display quality of the display device is maintained.

The correction performed by the determining step may be stopped if one of a video type and temperature satisfies a given condition. For example, if the previous-to-next grayscale level transition is a "fall" followed by a "rise" or a "rise" followed by a "fall," correcting the current video data to the previous video data may in the determining step may attenuate the facilitation of the current-to-next grayscale level transition in the modulating step. Therefore, if the current video data is corrected (even though one of the video type and temperature meets given conditions, for example, pixel temperature is high or the video is of a type with slow movements) and excess or poor brightness is unlikely to occur without correcting the current video data, response speed may undesirably decrease.

Accordingly, the correction in the determining step may be stopped if at least one of a video type and temperature satisfies a given condition. Therefore, decreases in response speed may thus be avoided, when excess or poor brightness is unlikely to occur. Since the current video data is corrected if neither temperature nor video type satisfy the conditions, excess or poor brightness occurrences may be prevented without any problems.

In addition to the arrangement, if a grayscale level falls in a transition from a previous grayscale level to the current grayscale level, the determining step may correct the current video data so as to indicate a higher grayscale level than a grayscale level predicted as having been reached by the pixel in the grayscale level transition.

The determining step may correct the current video data so that it indicates a grayscale level predicted as having been reached by the pixel in the previous-to-current grayscale level transition. However, when this is the case, if the actual grayscale level cannot be predicted with sufficient accuracy, excess or poor brightness may occur due to the deviation of the predicted value from the actual grayscale level.

In contrast, with the arrangement as described in the exemplary embodiments, if a grayscale level falls in a transition from a previous grayscale level to the current grayscale level, the current video data is corrected so as to indicate a higher grayscale level than a grayscale level predicted as having been reached by the pixel. Therefore, excess brightness occurrences are prevented even with a deviation of the predicted value from the actual grayscale level. As discussed in the foregoing, by preventing excess brightness occurrences which is more likely to degrade display quality than poor brightness occurrences, display quality is prevented from being degraded even if there exists a deviation of the predicted value from the actual grayscale level.

A display in accordance with an exemplary embodiment of the present invention may include a correction section and a processing section. The correction section may determine a resultant value based on a first drive signal input at a first time and a previous drive signal input at a time previous to the first time. The processing section may modulate a second drive signal, input at a second time that is subsequent to the first time, based on the resultant value received from the correction section to produce a corrected second drive signal for a pixel, so as to facilitate a tone transition from the first time to the second time.

The display thus arranged may drive the pixels by the aforementioned method of driving a display. Therefore, similarly to the method of driving a display, a display with good display quality may be provided using relatively small circuitry.

In addition to the arrangement, the correction circuit may have a lookup table containing grayscale levels for corrected current video data in association with combinations of the previous video data and the current video data; and a bit width of a grayscale level contained in the lookup table for the current video data may be set to either one of a bit width of a grayscale level for the previous video data and a bit width of a grayscale level for the current video data, whichever is smaller.

The correction section may include one or more lookup tables. With the arrangement, bit width of a grayscale level contained in a lookup table for the current video data may be set to the significant digits in the computation, based on the grayscale levels indicated by the previous and the current video data, that is, the smaller bit width. Therefore, the required storage capacity with the lookup table is reduced by the largest amount without adversely affecting computing accuracy.

One or more lookup tables may contain a grayscale level for the corrected current video data of a given one of the combinations of the previous video data and the current video data. The correction section may also include a control section. The control section may be adapted for interpolating between the grayscale levels for the corrected current video data contained in the lookup table to calculate grayscale levels for the corrected current video data corresponding to a combination of the previous video data and the current video data, for example.

With the arrangement, the combinations of the previous and current video data contained the lookup table may be limited in number to only those given grayscale levels, reducing the size of the lookup table storage capacity that is needed.

In addition to the arrangement, the correction section may also include a lookup table containing grayscale levels for corrected current video data in association with given ones of combinations of the previous video data and the current video data and grayscale levels per se indicated by the current video data in association with other combinations.

With the arrangement, for non-given combinations, the lookup table contains grayscale levels per se, as indicated by the current video data. The correction of the current video data may thus possible be stopped by correcting the current video data with reference to the lookup table for non-given combinations. As a result, display quality degradation due to errors in correction may be restrained, and excess or poor brightness occurrence may be prevented. Further, a simpler circuit arrangement may be used then in a case where a separate lookup table is provided to determine whether a combination is a given one or not.

In addition to the arrangement, the correction section may further include a plurality of lookup tables, each provided for a different given temperature range, and containing grayscale levels for corrected current video data in association with combinations of the previous video data and the current video data. Further, the correction section may include a control section adapted to select (in accordance with temperature) one of the lookup tables for use in correction of the current video data.

The control section may switch lookup tables for use in correction of the current video data based on pixel temperature, for example. Therefore, regardless of temperature, excess or poor brightness occurrence may be adequately prevented, and high display quality of the display device may be maintained. In addition, a lookup table may be prepared for each of a plurality of given temperature ranges. Therefore, a simple circuit may be provided that may be adapted to alter the correction process, even when temperature-caused changes in the correction process cannot be described using a simple mathematical expression.

In addition, the control section may select one of the lookup tables in accordance with a video data type. When the grayscale level indicated in the corrected current video data differs from the grayscale level which should be indicated in the current video data, the suitable value of the difference varies depending on the video type among other factors. Accordingly, with the arrangement, the control section switches between lookup tables for use in the correction of the current video data in accordance with the video data type. Therefore, excess brightness occurrence can be restrained for input of video of any type, for example, fast- or slow-moving video, with decreases in the response speed not easily recognizable.

In addition, the current video data and the previous video data stored in the memory section may have a combined bit width restricted to a given value. The current video data and the previous video data stored in the memory may have bit widths altered in accordance with temperature.

Pixel response speed changes with temperature. As, for example, pixel response speed falls, the grayscale level reached by a pixel in a grayscale level transition from the previous frame to the current frame becomes increasingly susceptible to the previous frame. Accordingly, desired bit width designation for the previous video data and the current video data stored in the memory also changes.

In accordance with the exemplary embodiments, the bit width designations may be maintained in suitable states regardless of temperature changes. Thus, the current video data may be corrected with improved accuracy, and excess or poor brightness occurrence is more adequately prevented.

The current video data and the previous video data stored in the memory section may have bit widths altered in accordance with a video data type, for example.

The grayscale level reached by a pixel in a grayscale level transition from the previous frame to the current frame becomes increasingly susceptible to the previous frame as the movements indicated in the input video become fast. Therefore, when the video type, hence the expected speed of movements, changes, optimal bit width designations of the previous video data and the current video data stored in the memory section also change.

In contrast, and in accordance with the exemplary embodiments, the bit width designations of the previous video data and the current video data stored in the memory section may be altered in accordance with the video type. As a result, regardless of the video type, the bit width designations may be maintained in a suitable state. Therefore, the current video data may be corrected with improved accuracy, and the occurrence of excess or poor brightness could be possibly reduced.

In addition, the next desired video data may be 8 bits wide for each of three primary colors, and the previous video data, (and optionally the current video data) may have a bit width restricted when stored in the memory, so that the previous video data and the current video data have a combined bit width of 10 bits for each one of the primary colors.

With the arrangement, the three primary colors may be assigned a combined bit width of 3×10=30 bits. A general purpose memory (one with its bit width set to 2 n) with an equal storage capacity as when the current video data (for three primary colors) is stored with no modification may be used as the memory, for example, although other memory configuration are possible.

The pixel may be embodied as a liquid crystal element of normally black, vertical align mode. Here, if a liquid crystal element of normally black, vertical align mode is used as a pixel, its response speed is slower when the grayscale level falls than when it rises in a transition. Accordingly, a difference is likely to develop between an actual grayscale level transition and a desired grayscale level transition in a falling previous-to-current grayscale level transition even after such modulated driving that the grayscale level transition is facilitated. Therefore, if a "fall" occurs followed by a "rise" in a grayscale level transition, easily recognizable excess brightness may likely occur.

In the present exemplary embodiments, a correction section may restrain excess brightness occurrence. Therefore, although a liquid crystal element of normally black, vertical align mode may be used as a pixel, excess brightness occurrence is prevented, and the display quality of the display device may be improved.

A program in accordance with the present invention may be a program causing a computer to execute steps of the method. Therefore, by causing a computer to execute the program, the display may be driven by the method. As a result, the display quality of the display may b similarly to the method of driving a display. These programs may also be provided in the form of a computer data signal. For example, the computer data signal may be carried on a carrier wave for transmission to a computer, where the programs are executed to drive a display using the exemplary method of driving the display.

These programs, when recorded on computer-readable storage media, are readily stored and distributed. Further, the storage medium, as it is read by a computer, drives the display by the drive method.

The exemplary embodiments of the present invention being thus described, it will be obvious that the same way may be varied in many ways. Such variations are not to be regarded as a departure from the spirit and scope of the exemplary embodiments of the present invention, and all such modifications as would be obvious to one skilled in the art are intended to be included within the scope of the following claims.

What is claimed:

1. A method of driving a display, comprising the steps of:

determining a resultant value based on a first drive signal associated with a first frame input at a first time and a previous drive signal associated with a previous frame input at a time previous to the first time; and modulating a second drive signal associated with a second frame, input at a second time that is subsequent to the first time, based on the determined resultant value to produce a corrected second drive signal for a pixel, so as to facilitate a tone transition from the first time to the second time.

2. The method of claim 1, wherein the resultant value is one of a corrected first drive signal and an uncorrected first drive signal.

3. The method of claim 1, further comprising:

storing current video data related to the first drive signal with previous video data related to the previous drive signal, wherein the step of determining further includes determining the resultant value based on the stored current and previous video data.

4. The method of claim 3, wherein the resultant value is one of a corrected first drive signal and an uncorrected first drive signal, and the determining step is dependent on a given combination of the previous data and current data.

5. The method of claim 4, wherein the determining step further includes correcting current video data of the first drive signal to obtain the corrected first drive signal, if a combination of the previous video data and current video data is the given combination, else, the determining step further includes outputting the uncorrected first drive signal.

6. The method of claim 4, wherein the given combination represents a correction amount to be applied to correct the first drive signal, the determining step further including altering the correction amount based on one of temperature and video type.

7. The method of claim 6, further comprising stopping the step of altering, if one of a video type and temperature satisfies a given threshold condition.

8. A computer-readable storage medium, on which is recorded a program adapted to cause a computer to execute the method of claim 1.

9. A method of driving a display, comprising the steps of:

determining a resultant value based on a first drive signal input at a first time and a previous drive signal input at a time previous to the first time; and modulating a second drive signal, input at a second time that is subsequent to the first time, based on the determined resultant value to produce a corrected second drive signal for a pixel, so as to facilitate a tone transition from the first time to the second time, wherein the previous, first, and second drive signals are embodied as one or more frames of video data, and the determining step further includes predicting a grayscale level reached by a pixel as a result of a grayscale level transition from previous video data of the previous drive signal to current video data of the first drive signal to correct the current video data of the first drive signal.

10. The method of claim 9, wherein the step of modulating further includes correcting video data of the second drive signal based on the corrected first drive signal to obtain the corrected second drive signal, so as to facilitate a grayscale level transition of the pixel from a current frame of the first drive signal to a next desired frame of the second drive signal.

11. A method of driving a display, comprising the steps of:

determining a resultant value based on a first drive signal input at a first time and a previous drive signal input at a time previous to the first time; and modulating a second drive signal, input at a second time that is subsequent to the first time, based on the determined resultant value to produce a corrected second drive signal for a pixel, so as to facilitate a tone transition from the first time to the second time, wherein the first drive signal is further comprised of current video data and the previous drive signal is further comprised of previous video data, and the step of determining includes correcting the current video data so as to indicate a higher grayscale level than a grayscale level predicted as having been reached by the pixel in the grayscale level transition, if a determined grayscale level based on current video data and previous video data falls in a transition from a previous grayscale level to the current grayscale level.

12. A method of driving a display, comprising the steps of:

determining a resultant value based on a first drive signal input at a first time and a previous drive signal input at a time previous to the first time;

storing current video data related to the first drive signal with previous video data related to the previous drive signal, the previous video data and the current video data have a given combination of bit width that is set to a desired value, the desired value being smaller than twice the bit width of a next desired video data for the second drive signal, the bit width of the previous video data is less than or equal to the bit width of the current video data, and a restricted bit width is stored so that the given combination of bit width assumes the desired value; and modulating a second drive signal, input at a second time that is subsequent to the first time, based on the determined resultant value to produce a corrected second drive signal for a pixel, so as to facilitate a tone transition from the first time to the second time, wherein the step of determining further includes determining the resultant value based on the stored current and previous video data and the resultant value is one of a corrected first drive signal and an uncorrected first drive signal.

13. A display, comprising:

means for determining a resultant value based on a first drive signal associated with a first frame input at a first time and a previous drive signal associated with a previous frame input at a time previous to the first time; and means for modulating a second drive signal associated with a second frame, input at a second time that is subsequent to the first time, based on the determined resultant value to produce a corrected second drive signal for a pixel, so as to facilitate a tone transition from the first time to the second time.

14. A computer program product comprising a computer-readable medium having computer program logic stored thereon for enabling a processor of the product to drive a display, the computer program logic causing the processor to perform the steps of:

determining a resultant value based on a first drive signal associated with a first frame input at a first time and a previous drive signal associated with a previous frame input at a time previous to the first time; and modulating a second drive signal associated with a second frame, input at a second time that is subsequent to the first time, based on the determined resultant value to produce a corrected second drive signal for a pixel, so as to facilitate a tone transition from the first time to the second time.

15. A display, comprising:

a correction section for determining a resultant value based on a first drive signal associated with a first frame input at a first time and a previous drive signal associated with a previous frame input at a time previous to the first time; and a processing section for modulating a second drive signal associated with a second frame, input at a second time that is subsequent to the first time, based on the resultant value received from the correction section to produce a corrected second drive signal for a pixel, so as to facilitate a tone transition from the first time to the second time.

16. The display of claim 15, wherein the resultant value is one of a corrected first drive signal and an uncorrected first drive signal.

17. The display of claim 15, further comprising:

a memory storing current video data related to the first drive signal with previous video data related to the previous drive signal, wherein the correction section determines the resultant value based on the stored current and previous video data.

18. The display of claim 17, wherein the resultant value is one of a corrected first drive signal and an uncorrected first drive signal, and the correction section determines the resultant signal based on a given combination of the previous data and current data.

19. The display of claim 18, wherein the correction section corrects current video data of the first drive signal to obtain the corrected first drive signal, if a combination of the previous video data and current video data is the given combination, else, the correction section outputs the uncorrected first drive signal.

20. The display of claim 18, wherein the given combination represents a correction amount to be applied to correct the first drive signal, and the correction section alters the correction amount based on one of temperature and video type.

21. The display of claim 20, wherein the correction section ceases altering the correction amount if one of a video type and temperature satisfies a given threshold condition.

22. The display of claim 17, wherein the pixel is a liquid crystal element of normally black, vertical align mode.

23. The display of claim 15, wherein the first drive signal is further comprised of current video data and the previous drive signal is further comprised of previous video data, and the correction section further includes:

a plurality of lookup tables, each lookup table directed to a different given temperature range and containing grayscale levels for corrected current video data associated with combinations of the previous video data and the current video data; and a control section for selecting one of the lookup tables for use in correction of the current video data based on temperature.

24. The display of claim 23, wherein the control section selects at least one of the lookup tables in accordance with a video data type.

25. A display, comprising:

a correction section for determining a resultant value based on a first drive signal input at a first time and a previous drive signal input at a time previous to the first time; and a processing section for modulating a second drive signal, input at a second time that is subsequent to the first time, based on the resultant value received from the correction section to produce a corrected second drive signal for a pixel, so as to facilitate a tone transition from the first time to the second time, wherein the previous, first, and second drive signals are embodied as one or more frames of video data, and the correction section further predicts a grayscale level reached by a pixel as a result of a grayscale level transition from previous video data of the previous drive signal to current video data of the first drive signal, so as to correct the current video data of the first drive signal.

26. The display of claim 25, wherein the processing section corrects video data of the second drive signal based on the corrected first drive signal to obtain the corrected second drive signal, so as to facilitate a grayscale level transition of the pixel from a current frame of the first drive signal to a next desired frame of the second drive signal.

27. A display, comprising;

a correction section for determining a resultant value based on a first drive signal input at a first time and a previous drive signal input at a time previous to the first time;

a memory storing current video data related to the first drive signal with previous video data related to the previous drive signal, the previous video data and the current video data have a given combination of bit width that is set to a desired value, the desired value being smaller than twice the bit width of a next desired video data for the second drive signal, the bit width of the previous video data is less than or equal to the bit width of the current video data, and a restricted bit width is stored so that the given combination of bit width assumes the desired value; and a processing section for modulating a second drive signal, input at a second time that is subsequent to the first time, based on the resultant value received from the correction section to produce a corrected second drive signal for a pixel, so as to facilitate a tone transition from the first time to the second time, wherein the correction section determines the resultant value based on the stored current and previous video data and the resultant value is one of a corrected first drive signal and an uncorrected first drive signal.

28. A display, comprising:

a correction section for determining a resultant value based on a first drive signal input at a first time and a previous drive signal input at a time previous to the first time; and a processing section for modulating a second drive signal, input at a second time that is subsequent to the first time, based on the resultant value received from the correction section to produce a corrected second drive signal for a pixel, so as to facilitate a tone transition from the first time to the second time, wherein the first drive signal includes current video data and the previous drive signal includes previous video data, the step of determining performed by the correction section includes correcting the current video data so as to indicate a higher grayscale level than a grayscale level predicted as having been reached by the pixel in the grayscale level transition, if a determined grayscale level based on current video data and previous video data falls in a transition from a previous grayscale level to the current grayscale level.

29. A display, comprising:

a correction section for determining a resultant value based on a first drive signal input at a first time and a previous drive signal input at a time previous to the first time: and a processing section for modulating a second drive signal, input at a second time that is subsequent to the first time, based on the resultant value received from the correction section to produce a corrected second drive signal for a pixel, so as to facilitate a tone transition from the first time to the second time, wherein:

the first drive signal includes is further comprised of current video data and the previous drive signal includes is further comprised of previous video data, and the correction section includes a lookup table containing grayscale levels for corrected current video data that is associated with combinations of the previous video data and the current video data; and a bit width of a grayscale level contained in the lookup table for the current video data is set to the smaller of a bit width of a grayscale level for the previous video data and a bit width of a grayscale level for the current video data.

30. The display of claim 29 wherein:

the lookup table contains a grayscale level for the corrected current video data that corresponds to a given one of a plurality of grayscale level combinations of previous video data and the current video data; and the correction section includes a control section for interpolating between the grayscale levels of the lookup table for the corrected current video data to calculate grayscale levels for the corrected current video data that corresponds to the combination of previous video data and current video data.

31. A display, comprising:

a correction section for determining a resultant value based on a first drive signal input at a first time and a previous drive signal input at a time previous to the first time; and a processing section for modulating a second drive signal, input at a second time that is subsequent to the first time, based on the resultant value received from the correction section to produce a corrected second drive signal for a pixel, so as to facilitate a tone transition from the first time to the second time, wherein the first chive signal is further comprised of current video data and the previous drive signal is further comprised of previous video data, and the correction section includes a lookup table containing grayscale levels for corrected current video data that corresponds to given combinations of the previous video data and the current video data, and which contains grayscale levels indicated by the current video data in association with other combinations.

32. A display, comprising:

a correction section for determining a resultant value based on a first drive signal input at a first time and a previous drive signal input at a time previous to the first time; and a processing section for modulating a second drive signal, input at a second time that is subsequent to the first time, based on the resultant value received from the correction section to produce a corrected second drive signal for a pixel, so as to facilitate a tone transition from the first time to the second time, wherein the first drive signal includes current video data and the previous drive signal includes previous video data stored in a memory, the correction section further includes:

a plurality of lookup tables, each lookup table directed to a different given temperature range and containing grayscale levels for corrected current video data associated with combinations of the previous video data and the current video data; and a control section for selecting one of the lookup tables for use in correction of the current video data based on temperature, and the current video data and the previous video data stored in the memory have a combined bit width restricted to a given value and the control section alters bit widths of the current video data and previous video data in accordance with temperature of a pixel.

33. A display, comprising:

a correction section for determining a resultant value based on a first drive signal input at a first time and a previous drive signal input at a time previous to the first time; and a processing section for modulating a second drive signal, input at a second time that is subsequent to the first time, based on the resultant value received from the correction section to produce a corrected second drive signal for a pixel, so as to facilitate a tone transition from the first time to the second time, wherein the first drive signal includes current video data and the previous drive signal includes previous video data, the current video data and the previous video data stored in a memory section have a combined bit width restricted to a given value; and the current video data and the previous video data stored in the memory section bit widths are adapted to be altered in accordance with a video data type.

34. A display, comprising:

a correction section for determining a resultant value based on a first drive signal input at a first time and a previous drive signal input at a time previous to the first time;

a memory storing current video data related to the first drive signal with previous video data related to the previous drive signal, one of the previous video data and current video data has its bit width restricted when stored in the memory, so that the previous video data and the current video data have a combined bit width of 10 bits for each one of the primary colors; and a processing section for modulating a second drive signal, input at a second time that is subsequent to the first time, based on the resultant value received from the correction section to produce a corrected second drive signal for a pixel, so as to facilitate a tone transition from the first time to the second time, the second driving signal includes video data that is 8 bits wide for each of three primary colors.

* * * * *